US010330064B2

(12) United States Patent
Sakamoto

(10) Patent No.: US 10,330,064 B2
(45) Date of Patent: Jun. 25, 2019

(54) CONTROL DEVICE FOR HIGH-PRESSURE PUMP

(71) Applicant: DENSO CORPORATION, Kariya, Aichi-pref. (JP)

(72) Inventor: Yuuki Sakamoto, Kariya (JP)

(73) Assignee: DENSO CORPORATION, Kariya (JP)

( * ) Notice: Subject to any disclaimer, the term of this patent is extended or adjusted under 35 U.S.C. 154(b) by 155 days.

(21) Appl. No.: 14/909,343

(22) PCT Filed: Jul. 14, 2014

(86) PCT No.: PCT/JP2014/003709
§ 371 (c)(1),
(2) Date: Feb. 1, 2016

(87) PCT Pub. No.: WO2015/015723
PCT Pub. Date: Feb. 5, 2015

(65) Prior Publication Data

US 2016/0186707 A1 Jun. 30, 2016

(30) Foreign Application Priority Data

Aug. 2, 2013 (JP) ..... 2013-161052

(51) Int. Cl.
*F02M 59/46* (2006.01)
*F02M 59/02* (2006.01)
(Continued)

(52) U.S. Cl.
CPC ..... *F02M 59/02* (2013.01); *F02D 41/20* (2013.01); *F02M 59/368* (2013.01);
(Continued)

(58) Field of Classification Search
CPC ..... F02D 2041/2055; F02D 2041/2058; F02D 41/3082; F02M 59/00–485; F16K 31/0675
See application file for complete search history.

(56) References Cited

U.S. PATENT DOCUMENTS 4,520,780 A * 6/1985 Ito ..... F02D 41/221 123/198 DB
5,477,149 A * 12/1995 Spencer ..... G01R 31/06 137/554
(Continued)

FOREIGN PATENT DOCUMENTS

JP 63-19803 1/1988
JP 3-17173 2/1991
(Continued)

OTHER PUBLICATIONS

International Search Report for PCT/JP2014/003709, dated Sep. 2, 2014, 5 pages.
(Continued)

*Primary Examiner* — Charles G Freay
*Assistant Examiner* — Thomas Fink
(74) *Attorney, Agent, or Firm* — Nixon & Vanderhye P.C.

(57) ABSTRACT

A high-pressure pump includes a plunger reciprocating in conjunction with rotation of a rotational shaft to be able to change a volume of a pressurizing chamber and a control valve having a first valve body and a second valve body disposed in a fuel suction passage that communicates with the pressurizing chamber and supplies/blocks fuel to/from the pressurizing chamber by displacing the valve body in an axial direction by switching between energization and non-energization of a coil. An ECU adjusts a fuel discharge amount of the high-pressure pump by switching a valve opening and a valve closing of the control valve by the energization control of the coil. The ECU detects movement
(Continued)

of the valve body with respect to a drive command of the valve opening or the valve closing of the control valve and executes an actuation determination of the high-pressure pump on the basis of a detection result.

5 Claims, 16 Drawing Sheets

(51) Int. Cl.
*F02M 63/00* (2006.01)
*F02M 59/36* (2006.01)
*F02D 41/20* (2006.01)
*F02D 41/38* (2006.01)

(52) U.S. Cl.
CPC ..... *F02M 59/464* (2013.01); *F02M 59/466* (2013.01); *F02M 63/0043* (2013.01); *F02M 63/0049* (2013.01); *F02D 41/3845* (2013.01); *F02D 2041/2051* (2013.01); *F02D 2041/2055* (2013.01); *F02D 2041/2058* (2013.01); *F02M 63/0033* (2013.01)

(56) References Cited

U.S. PATENT DOCUMENTS 5,650,909 A * 7/1997 Remele ..... F02D 41/20 361/154
5,797,360 A * 8/1998 Pischinger ..... F01L 9/04 123/90.11
5,808,471 A * 9/1998 Rooke ..... H01F 7/1844 324/418
6,211,665 B1 * 4/2001 Ahrendt ..... G01D 5/2013 324/207.16
6,321,700 B1 * 11/2001 Hein ..... F01L 9/04 123/90.11
6,619,245 B1 * 9/2003 Fujiwara ..... F01L 9/04 123/90.11
6,644,253 B2 * 11/2003 Haskara ..... F01L 9/04 123/90.11
6,925,975 B2 * 8/2005 Ozawa ..... F01L 9/04 123/90.11
9,624,883 B2 * 4/2017 Namuduri ..... F02M 51/0689
9,777,686 B2 * 10/2017 Nehl ..... F02M 51/0625
2001/0003972 A1 * 6/2001 Yamaki ..... F01L 9/04 123/90.11
2002/0158218 A1 * 10/2002 Fuwa ..... F01L 9/04 251/129.04
2005/0205045 A1 * 9/2005 Michelini ..... F02D 13/06 123/198 F
2007/0114481 A1 5/2007 Suyama
2007/0291438 A1 * 12/2007 Ahrens ..... F16K 31/06 361/160
2008/0143346 A1 * 6/2008 Rober ..... H01F 7/1844 324/654
2010/0237266 A1 9/2010 Haaf et al.
2012/0001105 A1 1/2012 Hayashi et al.
2012/0118271 A1 * 5/2012 Borg ..... F02D 41/20 123/495
2013/0032212 A1 * 2/2013 Tokuo ..... F02D 41/20 137/1
2013/0073188 A1 * 3/2013 Rosel ..... F02D 41/20 701/105
2013/0226488 A1 * 8/2013 Wirkowski ..... F02M 59/466 702/64
2013/0293174 A1 11/2013 Uda
2014/0014072 A1 * 1/2014 Bouaita ..... F02D 41/3005 123/490
2014/0069533 A1 * 3/2014 Gorzen ..... F02D 41/2467 137/554

FOREIGN PATENT DOCUMENTS

JP 3-21542 3/1991
JP 6-174139 6/1994
JP 2000-283327 10/2000
JP 2000-291821 10/2000
JP 2001-280189 10/2001
JP 2005-61583 3/2005
JP 2009-204128 9/2009
JP 2011-141019 7/2011

OTHER PUBLICATIONS

Written Opinion of the ISA for PCT/JP2014/003709, dated Sep. 2, 2014, 8 pages.

* cited by examiner

CONTROL DEVICE FOR HIGH-PRESSURE PUMP

CROSS REFERENCE TO RELATED APPLICATION

The application is the U.S. national phase of International Application No. PCT/JP2014/003709 filed 14 Jul. 2014, which designated the U.S. and claims priority to Japanese Patent Applications No. 2013-161052 filed on Aug. 2, 2013, the entire contents of each of which are hereby incorporated by reference.

TECHNICAL FIELD

The present disclosure relates to a control device for a high-pressure pump.

BACKGROUND ART

Conventionally, as a fuel supply system of an internal combustion engine, such as a gasoline engine or a diesel engine, a fuel supply system of an in-cylinder injection type that includes: a high-pressure pump for increasing pressure of low-pressure fuel that is pumped from a fuel tank to be high pressure; and a pressure accumulator chamber for storing high-pressure fuel that is pressure-fed from the high-pressure pump and that directly injects the high-pressure fuel in the pressure accumulator chamber from a fuel injection valve to inside of a cylinder of the internal combustion engine has been known. In addition, as the above high-pressure pump, a high-pressure pump that includes: a plunger that reciprocates within the cylinder; a pressurizing chamber into which the fuel from a low-pressure side is introduced; and a control valve of an electromagnetic drive type that adjusts a returning amount of the fuel introduced into the pressurizing chamber has been known.

As one example of the above high-pressure pump, the plunger is connected to a rotational shaft of an output shaft (a crankshaft) of the internal combustion engine, reciprocates within the cylinder when the rotational shaft rotates along with rotation of the crankshaft, and thus can change a volume of the pressurizing chamber. The control valve is an electromagnetic valve of a constantly open type, for example, and permits introduction of the fuel from a low-pressure side passage into the pressurizing chamber when a valve body is held at a valve opening position by a spring during non-energization of a solenoid coil. On the other hand, during energization of the coil, the valve body is displaced to a valve closing position by an electromagnetic force thereof and blocks the introduction of the fuel into the pressurizing chamber. In a state where the valve body of the control valve is at the valve opening position in a volume reduction stroke of the pressurizing chamber, a surplus of the fuel is returned from the pressurizing chamber to the low-pressure side in conjunction with movement of the plunger. Thereafter, when the valve body is controlled to be at the valve closing position by the energization of the coil, the fuel in the pressurizing chamber is pressurized by the plunger and discharged to a high-pressure side. In this way, discharge amount control of the high-pressure pump is executed.

During actuation of the control valve, collision sound may be produced when the valve body collides with a movement limiting member (a stopper), and the sound may give an occupant a sense of discomfort. In Patent Literature 1, various methods for reducing the collision sound between the valve body and the stopper in the discharge amount control of the high-pressure pump by the control valve are described. In Patent Literature 1, when the valve body moves to the valve closing position, the coil is energized at a minimum current value that is required to completely close the valve body. In this way, a time spent by the valve body to move to the valve closing position is extended, and a collision speed of the valve body with the stopper is reduced. Thereby, the collision sound is reduced.

In addition, in Patent Literature 1, in order to determine the above minimum current value, actual fuel pressure and target fuel pressure of the pressure accumulator chamber are compared, and the above minimum current value is determined on the basis of a current value at which a deviation of the actual fuel pressure from the target fuel pressure exceeds a threshold. In other words, when it is estimated that the current value applied to the coil is reduced and the actual fuel pressure of the pressure accumulator chamber falls below a lower limit value, it is estimated that complete closing of the control valve is not guaranteed. In addition, when the control valve is not completely closed, it is estimated that a fuel supply of the high-pressure pump is at least limited to such a degree that sufficiently high pressure can no longer be generated in the pressure accumulator chamber. In view of the above, in Patent Literature 1, the above minimum current value is determined on the basis of the current value at which the deviation of the actual fuel pressure from the target fuel pressure exceeds the threshold.

However, in the high-pressure pump, due to an individual difference or an environmental change, a variation in a fuel discharge amount with respect to the current value that is applied to the coil may be generated, and due to this variation, the fuel discharge amount may be increased or reduced from what is assumed. For this reason, when the actual fuel pressure and the target fuel pressure are compared and it is determined on the basis of a comparison result whether the fuel is discharged from the high-pressure pump (whether the pump is actuated), a relationship between the current value applied to the coil and an actuation state of the high-pressure pump at the current value may not accurately be comprehended.

PRIOR ART LITERATURES

Patent Literature

Patent Literature 1: JP2010-533820A

SUMMARY OF INVENTION

The present disclosure has been made to solve the above problem and therefore has a purpose of providing a control device for a high-pressure pump that can accurately comprehend an actuation state of the high-pressure pump.

According to an aspect of the present disclosure, the control device for a high-pressure pump is applied to a high-pressure pump including a plunger that reciprocates in conjunction with rotation of a rotational shaft so as to be able to change a volume of a pressurizing chamber, and a control valve that has a valve body disposed in a fuel suction passage that communicates with the pressurizing chamber and supplies/blocks fuel to/from the pressurizing chamber by displacing the valve body in an axial direction by energization control with respect to an electromagnetic section. The control device for the high-pressure pump adjusts a fuel discharge amount of the high-pressure pump by switching a valve opening and a valve closing of the control valve by the energization control. The control device for the high-pressure pump includes a movement detection section detecting movement of the valve body with respect to a drive command of the valve opening or the valve closing of the control valve, and an actuation determination section making an actuation determination of the high-pressure pump on the basis of a detection result of the movement detection section.

When the first valve body and the second valve body show the normal movement with respect to the drive command of the valve opening/valve closing of the control valve, the high-pressure pump is actuated, and the fuel is discharged from the high-pressure pump. On the other hand, when the first valve body and the second valve body do not show the normal movement with respect to the drive command, the high-pressure pump is not actuated, and the fuel is not discharged from the high-pressure pump. Attention is focused on this point. In the above configuration, the movement of the valve body with respect to the drive command of the valve opening or the valve closing of the control valve is monitored, and the actuation state of the high-pressure pump is determined from the movement of the valve body. Thus, the actuation state of the high-pressure pump can accurately be comprehended.

It is preferable that the movement detection section detects the movement of the valve body with respect to the drive command by detecting at least one of a change in a current flowing through the electromagnetic section, a change in a voltage applied to the electromagnetic section, a displacement amount of the valve body, and a vibration of the control valve. Therefore, the actuation state of the high-pressure pump can be directly or indirectly monitored, and the actuation state of the high-pressure pump can accurately be comprehended.

BRIEF DESCRIPTION OF DRAWINGS

The above and other objects, features and advantages of the present disclosure will become more apparent from the following detailed description made with reference to the accompanying drawings. In the drawings.

DESCRIPTION OF EMBODIMENTS

Figure 1:
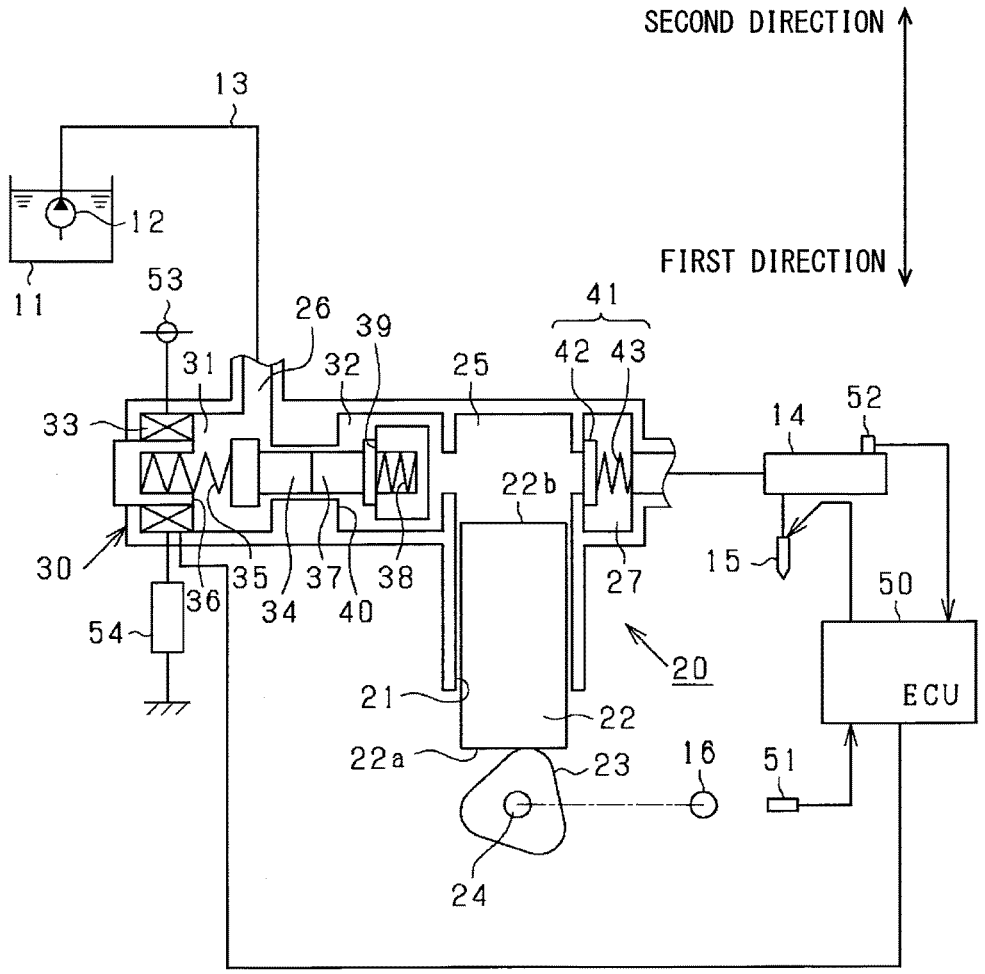
FIG. 1 is a configuration diagram of an overall outline of a fuel supply system of an engine of a first embodiment.

Hereafter, referring to drawings, an embodiment of the present invention will be described. In addition, the substantially same parts and components are indicated with the same reference numeral in following embodiments.

First Embodiment

A description will hereinafter be made on a first embodiment in which the present disclosure is embodied with reference to the drawings. In this embodiment, a fuel supply system for supplying fuel to an on-vehicle gasoline engine of an in-cylinder injection type as an internal combustion engine is constructed. The system controls a fuel discharge amount of a high-pressure pump, a fuel injection amount of an injector, and the like with an electronic control unit (ECU) being a central part. An overall schematic configuration diagram of the system is depicted in FIG. 1.

A fuel tank 11 is provided in the fuel supply system of FIG. 1. Fuel stored in the fuel tank 11 is pumped by a low-pressure pump 12 of an electromagnetic drive type that corresponds to a feed pump, and is introduced into a high-pressure pump 20 via a low-pressure pipe 13. Pressure of the fuel that has been introduced in the high-pressure pump 20 is increased to be high pressure by the high-pressure pump 20 and is then pressure-fed to a pressure accumulator chamber 14. The high-pressure fuel that has been pressure-fed is stored in a high-pressure state in the pressure accumulator chamber 14, and is then directly injected into a cylinder from an injector 15 that is attached to each of the cylinders of the engine.

Next, the high-pressure pump 20 will be described. The high-pressure pump 20 of the system is configured as a plunger pump and performs suction and discharge of the fuel in conjunction with movement of a plunger.

More specifically, as depicted in FIG. 1, in the high-pressure pump 20, a cylinder 21 is disposed in a pump main body, and a plunger 22 is inserted in the cylinder 21 in a freely reciprocating manner in an axial direction. A first end 22*a* of the plunger 22 abuts against a cam 23 by an urging force of a spring, which is not depicted. The cam 23 has multiple cam ridges and is fixed to a camshaft 24 that rotates along with rotation of an output shaft (a crankshaft 16) of the engine. In this embodiment, the camshaft 24 is referred to as a rotational shaft 24. In this way, when the crankshaft 16 rotates during an operation of the engine, the plunger 22 can move within the cylinder 21 in the axial direction in conjunction with rotation of the cam 23.

A pressurizing chamber 25 is provided on a second end 22*b* of the plunger 22. The pressurizing chamber 25 communicates with a fuel suction passage 26 and a fuel discharge passage 27, and introduction/discharge of the fuel into/from the pressurizing chamber 25 are performed via these passages 26, 27. More specifically, when the plunger 22 moves in a first direction to increase a volume of the pressurizing chamber 25, in conjunction with the movement, low-pressure fuel in the low-pressure pipe 13 is introduced into the pressurizing chamber 25 via the fuel suction passage 26. In addition, when the plunger 22 moves in a second direction to reduce the volume of the pressurizing chamber 25, in conjunction with the movement, the fuel in the pressurizing chamber 25 is discharged from the pressurizing chamber 25 to the fuel discharge passage 27.

A control valve 30 for adjusting a fuel discharge amount of the high-pressure pump 20 is provided in a fuel entry portion of the high-pressure pump 20 that is on an upstream side of the pressurizing chamber 25. The control valve 30 is configured as an opening/closing valve that performs supply/blockage of the fuel to/from the pressurizing chamber 25 by displacing a valve body in an axial direction by energization control of a coil 33 as an electromagnetic section. The fuel suction passage 26 is provided on the inside of the control valve 30, and in the fuel suction passage 26, a first valve chamber 31 and a second valve chamber 32 are sequentially formed along a flow of the fuel.

A first valve body 34 that is displaced by non-energization/energization of the coil 33 is accommodated in the first valve chamber 31. The first valve body 34 is held at a valve opening position by a first spring 35 as an urging section during the non-energization of the coil 33, and is displaced against an urging force of the first spring 35 to a position (a valve closing position) to abut against a first stopper 36 as a movement limiting member for limiting movement of the first valve body 34 during the energization of the coil 33. A power supply 53 is connected to an input terminal side of the coil 33, and electricity is supplied from the power supply 53 to the coil 33.

A second valve body 37 that is coaxially disposed with the first valve body 34 is accommodated in the second valve chamber 32. The second valve body 37 can be displaced along with the movement of the first valve body 34. More specifically, when the first valve body 34 is at the valve opening position, the second valve body 37 is pressed by the first valve body 34 in the axial direction and is thereby held at a position (a valve opening position) to abut against a second stopper 39 as a movement limiting member for limiting movement of the second valve body 37 against an urging force of a second spring 38. In this state, the second valve body 37 separates from a valve seat 40, and the low-pressure pipe 13 and the pressurizing chamber 25 communicate with each other. Accordingly, the introduction of the low-pressure fuel into the pressurizing chamber 25 is permitted. On the other hand, when the first valve body 34 is at the valve closing position in conjunction with the energization of the coil 33, the second valve body 37 is released from being pressed by the first valve body 34, is thus seated on the valve seat 40 by the urging force of the second spring 38, and is held at the valve closing position. In this state, communication between the low-pressure pipe 13 and the pressurizing chamber 25 is brought into a blocked state, and the introduction of the low-pressure fuel into the pressurizing chamber 25 is blocked.

The pressurizing chamber 25 is connected to the pressure accumulator chamber 14 via the fuel discharge passage 27. In addition, a check valve 41 is provided in the middle of the fuel discharge passage 27. The check valve 41 includes a check valve main body 42 and a check valve spring 43, and the check valve main body 42 is displaced in an axial direction when fuel pressure in the pressurizing chamber 25 becomes at least equal to predetermined pressure. More specifically, when the fuel pressure in the pressurizing chamber 25 is lower than the predetermined pressure, the check valve main body 42 is brought into a state of being held at a valve closing position by an urging force of the check valve spring 43, and thus discharge of the fuel from the pressurizing chamber 25 to the fuel discharge passage 27 is blocked. Meanwhile, when the fuel pressure in the pressurizing chamber 25 becomes at least equal to the predetermined pressure, the check valve main body 42 is displaced (opened) against the urging force of the check valve spring 43, and the discharge of the fuel from the pressurizing chamber 25 to the fuel discharge passage 27 is permitted.

In addition to the above, the system is provided with various sensors, such as a crank angle sensor 51 for outputting a rectangular crank angle signal at every predetermined crank angle of the engine, a fuel pressure sensor 52 for detecting fuel pressure in the pressure accumulator chamber 14, and a current sensor 54 for detecting an output current of the coil 33. The output current of the coil 33 corresponds to a coil current that flows through the coil 33.

As it has been well known, an ECU 50 is constructed of a microcomputer formed of a CPU, a ROM, a RAM, and the like as a main body, and executes various types of engine control in accordance with an operation state of the engine at the time by executing various control programs stored in the ROM. That is, the microcomputer of the ECU 50 receives detection signals from the above-described various sensors and the like, computes control amounts of various parameters related to the operation of the engine on the basis of these detection signals, and controls driving of the injector 15 and the control valve 30 on the basis of the computation values.

In this embodiment, in order to bring actual fuel pressure that is detected by the fuel pressure sensor 52 to target fuel pressure, as discharge amount control of the high-pressure pump 20, feedback control that is based on a deviation of the actual fuel pressure from the target fuel pressure is executed. In this way, the fuel pressure in the pressure accumulator chamber 14 is controlled to become pressure (the target fuel pressure) that corresponds to the operation state of the engine. In addition, an energization amount of the coil 33 is adjusted by duty control.

The discharge amount control of the high-pressure pump 20 will further be described. The microcomputer of the ECU 50 adjusts the fuel discharge amount of the high-pressure pump 20 by controlling valve closing timing of the control valve 30. More specifically, the ECU 50 is connected to the coil 33 of the control valve 30 via a coil drive circuit, which is not depicted, and controls an application voltage and energization timing of the coil 33 by outputting a drive command of valve opening/valve closing of the control valve 30 to the coil drive circuit.

Figure 2A:
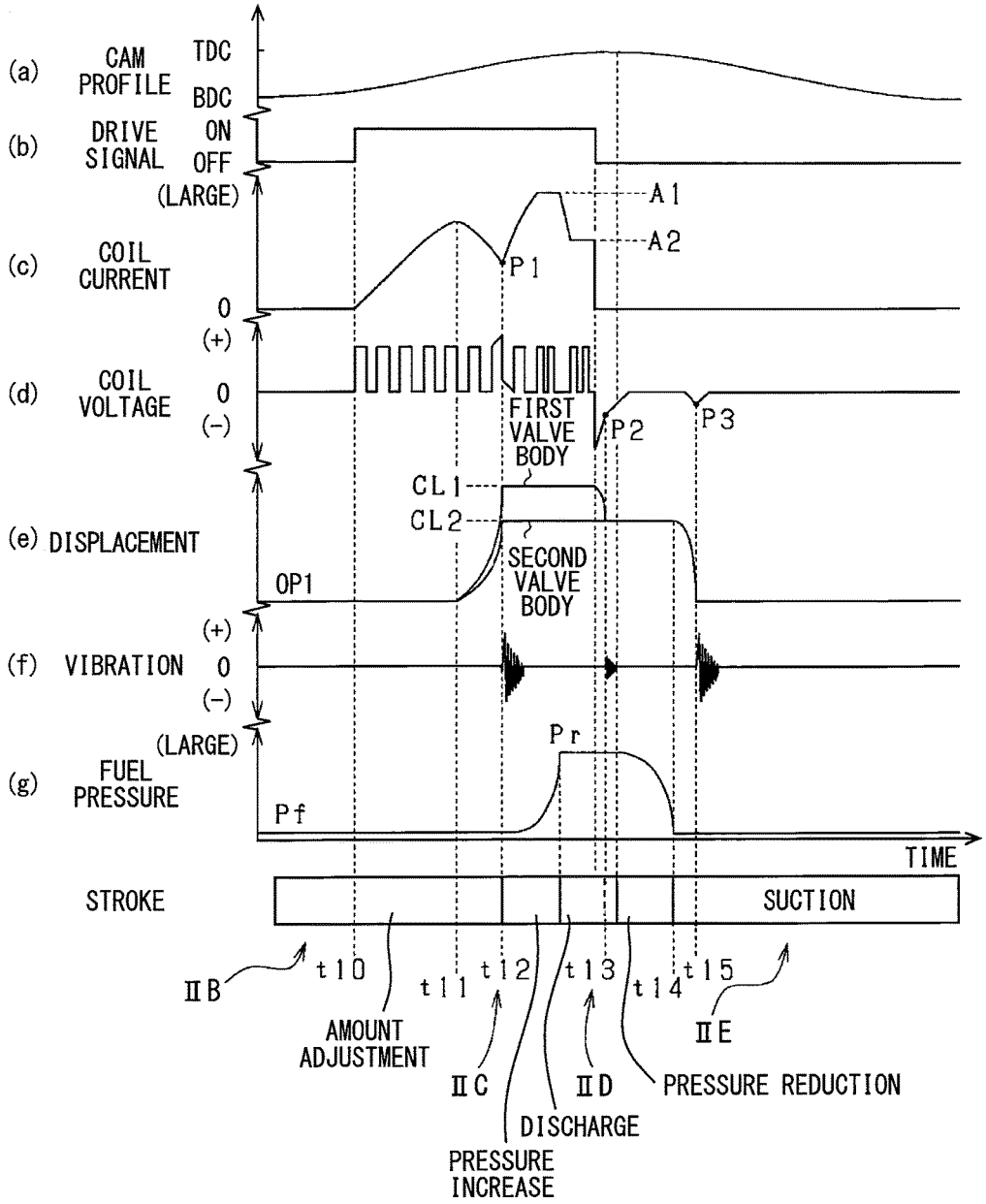
FIG. 2A is a time chart of a behavior during actuation of a high-pressure pump.

FIG. 2A is a time chart of a behavior when the high-pressure pump 20 is actuated normally with respect to the drive command by the ECU 50. In FIG. 2A, (a) indicates a relationship between a position of the plunger 22 that is associated with the rotation of the cam 23 and time, (b)

indicates a relationship between a drive signal of the control valve 30 and time, (c) indicates a relationship between the output current of the coil 33 and time, (d) indicates a relationship between a coil voltage and the time, the coil voltage being a voltage between an input terminal and an output terminal of the coil 33, (e) indicates relationships between displacements of the first valve body 34 and the second valve body 37 from the valve opening positions and time, (f) indicates a relationship between a vibration that is generated in the control valve 30 (for example, the valve main body) and time, and (g) indicates a relationship between the fuel pressure in the pressurizing chamber 25 and time. The position of the plunger 22 that is associated with the rotation of the cam 23 corresponds to a profile of the cam 23. The coil voltage is also referred to as a voltage between the input/output terminals.

In (a), BDC represents bottom dead center of the plunger 22, and TDC represents top dead center of the plunger 22. Regarding the drive signal of (b), an OFF signal is outputted in a case of a valve opening command for keeping the control valve 30 to be in a valve opened state, and an ON signal is outputted in a case of a valve closing command for keeping the control valve 30 to be in a valve closed state. In (g), Pf represents feed pressure as fuel pressure in the low-pressure pipe 13, and Pr represents rail pressure as the fuel pressure in the pressure accumulator chamber 14.

Figure 2B:
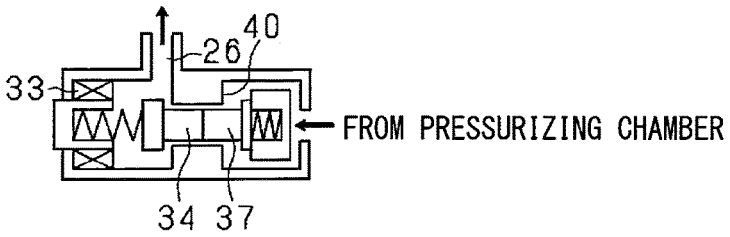
FIG. 2B is a view of an operation of the high-pressure pump indicated by IIB in FIG. 2A.
Figure 2C:
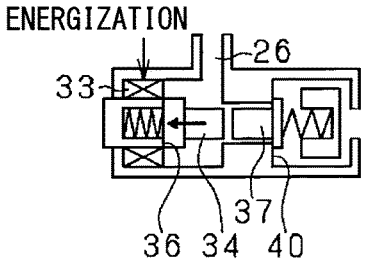
FIG. 2C is a view of the operation of the high-pressure pump indicated by IIC in FIG. 2A.
Figure 2D:
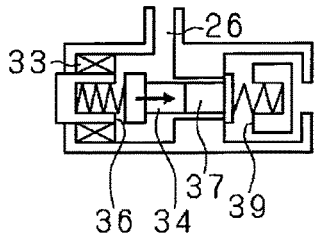
FIG. 2D is a view of the operation of the high-pressure pump indicated by IID in FIG. 2A.
Figure 2E:
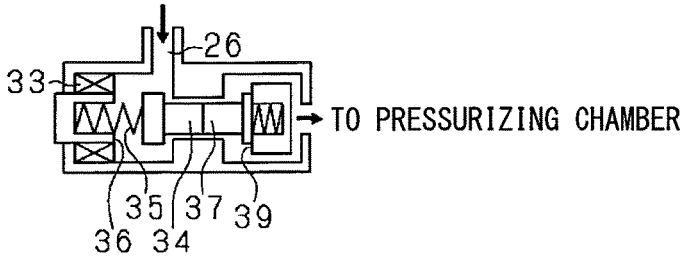
FIG. 2E is a view of the operation of the high-pressure pump indicated by IIE in FIG. 2A.

In a volume increase stroke that corresponds to a period in which the plunger 22 moves in the first direction to increase the volume of the pressurizing chamber 25 in conjunction with the rotation of the cam 23, as depicted in FIG. 2E, the coil 33 is not energized, and the first valve body 34 and the second valve body 37 are set at the valve opening positions. That is, the first valve body 34 is in a state of separating from the first stopper 36 by the urging force of the first spring 35, and the second valve body 37 is in a state of abutting against the second stopper 39 by the first valve body 34. In this way, the pressurizing chamber 25 and the fuel suction passage 26 are brought into a communicating state, and the low-pressure fuel is introduced into the pressurizing chamber 25. In this embodiment, a period in which the low-pressure fuel is introduced into the pressurizing chamber 25 is a suction stroke.

In a period in which the plunger 22 moves from the bottom dead center to the top dead center, the volume of the pressurizing chamber 25 is reduced. In a volume reduction stroke that corresponds to this period, valve closing is commanded at timing that corresponds to a requested discharge amount, and the energization of the coil 33 is started. At this time, before a start of the energization of the coil 33 (before t12), the second valve body 37 is in a state of separating from the valve seat 40. Accordingly, as depicted in FIG. 2B, the fuel in the pressurizing chamber 25 is returned to the fuel suction passage 26 side along with the movement of the plunger 22. In this embodiment, a period in which the fuel in the pressurizing chamber 25 is returned to the fuel suction passage 26 side is an amount adjustment stroke.

The first valve body 34 is attracted toward the coil 33 by the start of the energization of the coil 33, and as depicted in FIG. 2C, the first valve body 34 moves to a valve closing position CL1 that is a position at which the first valve body 34 abuts against the first stopper 36. At this time, the first valve body 34 collides with the first stopper 36. In this way, the vibration is generated as depicted in (f) in FIG. 2A. Once a predetermined time elapses from the start of the energization of the coil 33, the pressurizing chamber 25 and the fuel suction passage 26 are brought into a state where the communication therebetween is blocked by the second valve body 37. In this case, the predetermined time is a valve closing required time that corresponds to a time required for the second valve body 37 to be actually seated on the valve seat 40 and brought into the valve closed state from switching to the ON signal. When the plunger 22 moves in the second direction in this state, the fuel pressure in the pressurizing chamber 25 is increased. In this embodiment, a period in which the fuel pressure in the pressurizing chamber 25 is increased is a pressure increase stroke. High-pressure fuel, pressure of which has been increased to be high, is discharged to the fuel discharge passage 27 side. In this embodiment, a period in which the high-pressure fuel is discharged to the fuel discharge passage 27 side is a discharge stroke. Accordingly, a pump discharge amount is increased by advancing energization start timing of the coil 33, and the pump discharge amount is reduced by delaying the timing.

In the pressure increase stroke, as depicted in (g) in FIG. 2A, the fuel pressure in the pressurizing chamber 25 is increased, but the pressure increase appears after the timing t12 at which movement of the first valve body 34 and the second valve body 37 to the valve closing positions are completed. In addition, a delay occurs to transmission of a pressure change of the pressurizing chamber 25 to the pressure accumulator chamber 14 due to presence of a fuel pipe. Thus, it takes time until the movement of the valve body appears as a change in the fuel pressure in the pressure accumulator chamber 14.

When the energization of the coil 33 is stopped, as depicted in FIG. 2D, the first valve body 34 separates from the first stopper 36, abuts against the second valve body 37, and is held in an abutment state for a predetermined time that corresponds to t13 to t14. In the abutment state of both, the first valve body 34 and the second valve body 37 are held at a valve closing position CL2 of the second valve body 37. At this time, due to collision of the first valve body 34 with the second valve body 37, the vibration is generated as depicted in (f) in FIG. 2A.

Thereafter, when the plunger 22 moves from the top dead center toward the bottom dead center, the volume of the inside of the pressurizing chamber 25 is increased, and the pressure in the pressurizing chamber 25 is reduced. In this embodiment, a period in which the pressure in the pressurizing chamber 25 is reduced is a pressure reduction stroke. In this way, at t14 onward, fuel pressure in the second valve chamber 32 is reduced. Thus, the first valve body 34 and the second valve body 37 are permitted to move and each move to the valve opening position. At timing t15, the second valve body 37 collides with the second stopper 39 when being pressed by the first valve body 34 in the axial direction, and the vibration is thereby generated as depicted in (f) in FIG. 2A.

In the case where the first valve body 34 and the second valve body 37 move in conjunction with the energization of the coil 33, the movement thereof appears as a change in a current that flows through the coil 33. More specifically, due to a coil characteristic, as the first valve body 34 approaches the coil 33, inductance of the coil 33 is increased, and the current flowing through the coil 33 is gradually reduced. Thus, in a state where a predetermined voltage is applied from the power supply 53 to the coil 33 by the duty control, as depicted in (c) in FIG. 2A, the coil current is increased over time until the first valve body 34 starts moving. When the first valve body 34 starts moving from a valve opening position OP1 (t11), the coil current is gradually reduced as the first valve body 34 approaches the valve closing position CL1 (an abutment position against the first stopper 36). When the first valve body 34 abuts against the first stopper 36 and thereby stops moving, the inductance is stabilized again, and the coil current is increased again. That is, in the case where the first valve body 34 moves in conjunction with the energization of the coil 33, as depicted in (c) in FIG. 2A, in an ON period of the drive signal, the coil current is switched from an increased tendency to a reduced tendency and is thereafter shifted from the reduced tendency to an increase. In this way, a bending point P1 appears to the coil current in the ON period of the drive signal.

In the system, immediately after switching from ON to OFF of the drive signal, the voltage in a reverse direction is applied to the coil 33. In this way, flyback for accelerating a reduction speed of the current that flows through the coil 33 is executed. Accordingly, as depicted in FIG. 2A, when the drive signal is switched from ON to OFF, the coil current immediately becomes 0. Meanwhile, the voltage between the input/output terminals of the coil 33 is significantly changed in a reverse direction in conjunction with the switching of the drive signal from ON to OFF, is then shifted to a gradual increase, and is eventually converged to 0. In addition, in the system, an upper guard value is provided to the current that flows through the coil 33. As the upper guard value, A1 is set for a predetermined time from the energization start timing, and A2 is set after a lapse of the predetermined time. In this embodiment, A1 is larger than A2.

In the case where the first valve body 34 and the second valve body 37 move in conjunction with the energization of the coil 33, the movement thereof appears as a change in a voltage that is applied to the coil 33. In this embodiment, the voltage that is applied to the coil 33 is the voltage between the input/output terminals of the coil 33. More specifically, in the ON period of the drive signal, as depicted in (d) in FIG. 2A, in conjunction with a change in the inductance of the coil 33 that is caused by approaching of the first valve body 34 to the coil 33, the voltage is changed by a predetermined value or more near the timing t12, and the change is apart from a voltage change by the duty control.

In addition, after the switching from ON to OFF of the drive signal, the voltage between the input/output terminals of the coil 33 is significantly changed in the reverse direction by the flyback, is then shifted to the increase, and is converged to 0. In a period in which the voltage is reduced toward zero, a change amount of the voltage per unit time is reduced, and a bending point P2 appears. That is, the inductance of the coil 33 is reduced as the first valve body 34 separates from the coil 33 by the timing t13 at which the first valve body 34 abuts against the second valve body 37, and the inductance becomes constant when the movement of the first valve body 34 is stopped. The change in the inductance appears as the voltage change.

Furthermore, in a period after the voltage is converged to zero, the inductance of the coil 33 is changed by displacement of the first valve body 34 from the abutment position CL2 that is associated with a reduction in the pressure of the second valve chamber 32. In conjunction with this, the voltage between the input/output terminals of the coil 33 is changed. This change appears as a bending point P3.

By the way, when the first valve body 34 and the second valve body 37 show normal movement in conjunction with the switching of the drive command (the switching of the ON signal/OFF signal) of the valve opening/valve closing of the control valve 30, the high-pressure pump 20 is actuated, that is, the fuel is discharged from the high-pressure pump 20. On the other hand, when at least one of the first valve body 34 and the second valve body 37 does not show the normal movement, the high-pressure pump 20 is not actuated, that is, the fuel is not discharged from the high-pressure pump 20.

Figure 3:
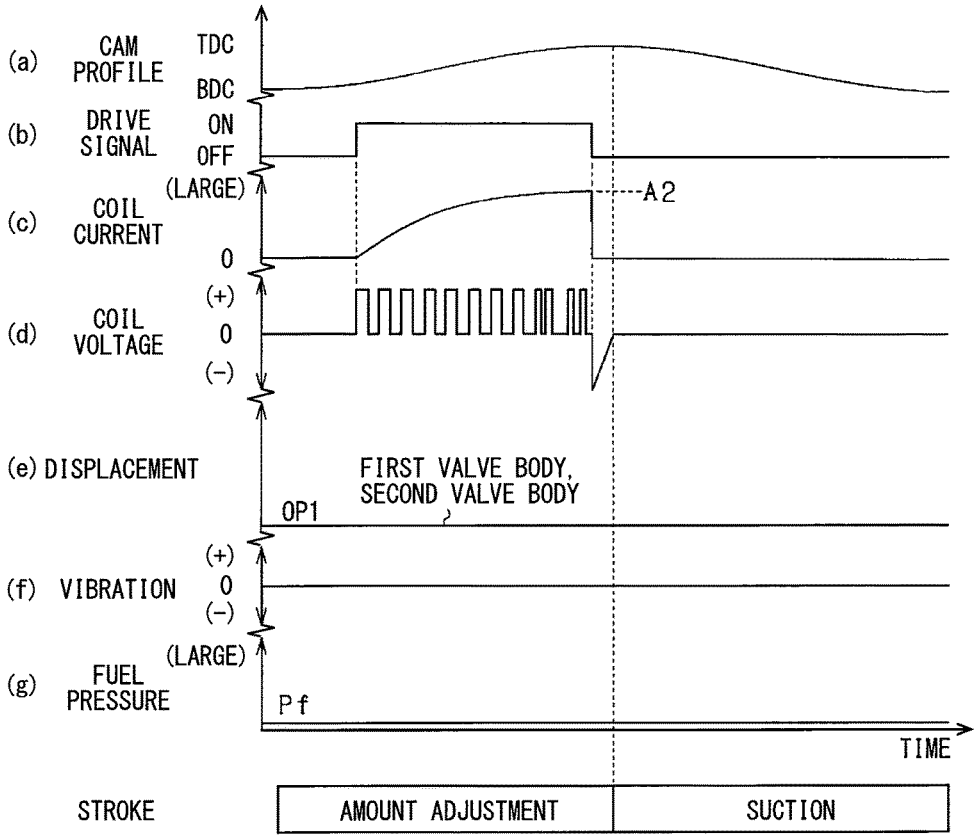
FIG. 3 is a time chart of a behavior during non-actuation of the high-pressure pump.

For example, in the case where the first valve body 34 is not displaced from the valve opening position regardless of output of the drive signal for switching from the valve opening to the valve closing of the control valve 30, a state in FIG. 2B is retained after the output of the drive signal. In such a case, as depicted in FIG. 3, even when the drive signal is switched between ON/OFF, behaviors that are observed when the first valve body 34 and the second valve body 37 show the normal movement, more specifically, a change in the coil current and the change in the voltage in the ON period of the drive signal as well as the change in the voltage after the switching of the drive signal from ON to OFF are not observed.

For this reason, in this embodiment, a movement detection section for detecting the movement of the first valve body 34 and the second valve body 37 with respect to the drive command of the valve opening/valve closing of the control valve 30 is provided, and based on a detection result of the movement detection section, an actuation determination of the high-pressure pump 20 is made. That is, the movement of the first valve body 34 and the movement of the second valve body 37 at a time that the drive signal of the control valve 30 is switched are directly or indirectly detected, and the actuation determination of the high-pressure pump 20 is made by determining whether the first valve body 34 and the second valve body 37 have normally moved by the drive signal.

In this embodiment, attention is focused on the movement of the first valve body 34 with respect to the drive command of the valve closing of the control valve 30 that appears in a synchronous manner with the movement of the first valve body 34 resulted from the change in the current flowing through the coil 33. By indirectly detecting the movement of the first valve body 34 on the basis of the change in the current, whether to permit the actuation of the high-pressure pump 20 is determined. More specifically, as the change in the current with respect to the drive command, switching of the coil current between the increased tendency and the reduced tendency is detected. In this embodiment, generation of the reduced tendency of the coil current is detected in a period in which the drive command of the valve closing of the control valve 30 is outputted. When the generation of the reduced tendency is detected, such a determination that the high-pressure pump 20 is actuated is made.

Figure 4:
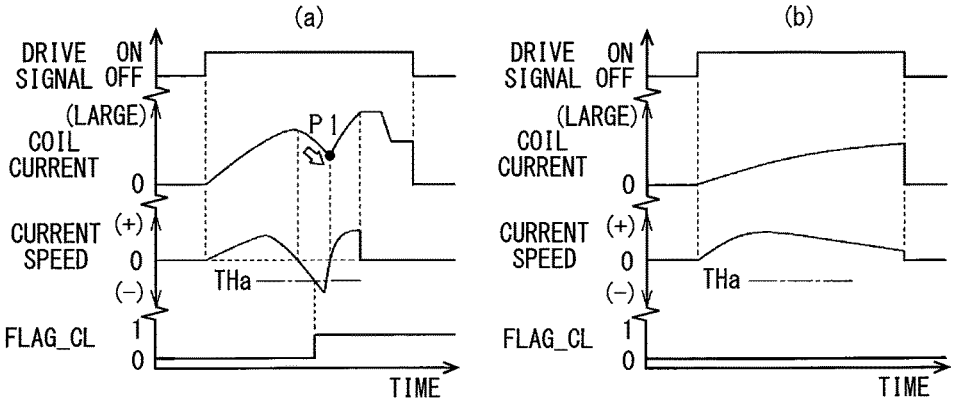
FIG. 4 includes time charts for depicting a method for detecting movement of a valve body on the basis of a current speed.

FIG. 4 includes time charts of specific aspects of a pump actuation determination of this embodiment. In this embodiment, the generation of the reduced tendency of the coil current in the ON period of the drive signal is detected on the basis of a current speed that corresponds to a differential value of the current. That is, when the first valve body 34 moves to the valve closing position, as depicted in FIG. 4(*a*), a reduced tendency of a coil current value is generated in the ON period of the drive signal, and the current speed shows a negative value. On the other hand, when the movement of the first valve body 34 is not observed in conjunction with the drive command of the valve closing of the control valve 30, as depicted in FIG. 4(*b*), the current speed does not show the negative value in the ON period of the drive signal. In this embodiment, the current speed and a determination value THa are compared by using this, and based on a comparison result, whether to permit the actuation of the high-pressure pump 20 is determined. In this embodiment, the determination value THa is smaller than zero.

Next, a process procedure of a pump actuation determination process of this embodiment will be described by using a flowchart in FIG. 5. The pump actuation determination process is executed by the microcomputer of the ECU 50 at predetermined intervals.

Figure 5:
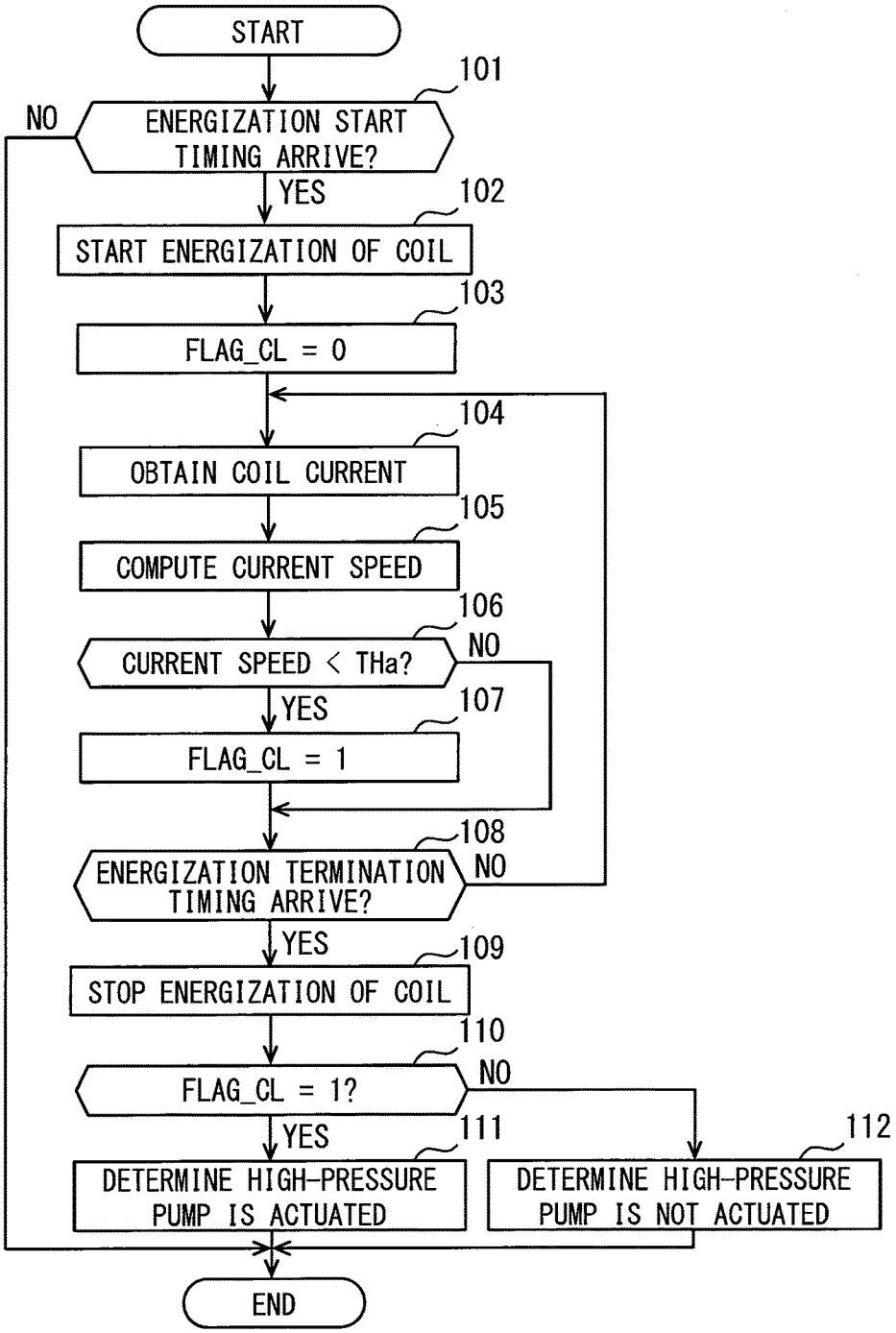
FIG. 5 is a flowchart of a pump actuation determination process of the first embodiment.

In FIG. 5, the microcomputer determines in 101 whether the energization start timing for energizing the coil 33 arrives. When the energization start timing arrives, the process proceeds to 102, and the microcomputer outputs the valve closing command of the control valve 30. In this way, the coil 33 is energized from the power supply 53. In 103, the microcomputer resets a valve closing determination flag FLAG_CL to 0. The valve closing determination flag FLAG_CL is a flag for indicating that the control valve 30 is in the valve closed state. When the microcomputer determines that the control valve 30 is in the valve closed state, the valve closing determination flag FLAG_CL is set to 1.

In 104, the microcomputer obtains the coil current value that is detected by the current sensor 54. In 105, the microcomputer computes the current speed that corresponds to a speed of the output current. In 106, the microcomputer determines whether the computed current speed falls below the determination value THa. When the microcomputer makes a positive determination, the process proceeds to 107, and the valve closing determination flag FLAG_CL is set to 1. In this embodiment, the processes in 103, 106, and 107 correspond to the movement detection section.

The microcomputer determines in 108 whether energization termination timing for terminating the energization of the coil 33 arrives. When the energization termination timing arrives, the process proceeds to 109, and the microcomputer outputs the valve opening command of the control valve 30. In this way, the energization of the coil 33 from the power supply 53 is stopped. In 110, the microcomputer loads the valve closing determination flag FLAG_CL and determines whether FLAG_CL is 1. When FLAG_CL is 1, the process proceeds to 111, and the microcomputer determines that the high-pressure pump 20 is actuated normally. When FLAG_CL is 0, the process proceeds to 112, and the microcomputer determines that the high-pressure pump 20 is not actuated. In this embodiment, the processes in 110, 111, and 112 correspond to an actuation determination section. Then, the microcomputer terminates this routine.

The fuel discharge amount of the high-pressure pump 20 is controlled by energization start timing TIME_ON of the control valve 30 and is specifically expressed by a following equation (1).

$$\text{TIME_ON}=\text{TIME_}Q+\text{TIME_}P+\text{TIME_}F/B+\text{TIME_CL} \quad (1)$$

In the equation (1), TIME_Q represents a discharge time that corresponds to a time required to discharge the fuel in the pressurizing chamber 25, TIME_P represents a pressure increase time that corresponds to a time required to increase the pressure of the fuel in the pressurizing chamber 25, TIME_F/B represents a fuel pressure feedback correction amount, and TIME_CL represents the valve closing required time.

The discharge time TIME_Q is computed on the basis of the requested discharge amount of the high-pressure pump 20, and a longer time is set therefor as the requested discharge amount is increased. The pressure increase time TIME_P is computed on the basis of the target fuel pressure, and a longer time is set therefor as the target fuel pressure is increased. The fuel pressure feedback correction amount TIME_F/B is computed on the basis of a deviation of the actual fuel pressure in the pressure accumulator chamber 14 from the target fuel pressure, and a larger value is set therefor as the deviation is increased.

The valve closing required time TIME_CL is a time required for the second valve body 37 to move to the valve closing position from the energization start timing (valve closing command timing) and differs by individual units, a change over time, and the like, for example. When the valve closing required time differs, the fuel discharge amount of the high-pressure pump 20 is changed, and thus fuel pressure control may be influenced by the change.

For the above reason, in this embodiment, the microcomputer actually measures the valve closing required time and, based on the measured time, executes an energization start timing computation process for computing the energization start timing of the control valve 30. In this embodiment, the microcomputer computes the valve closing required time by using the detection result of the movement detection section. In this way, computation accuracy of the valve closing required time is increased.

Figure 6:
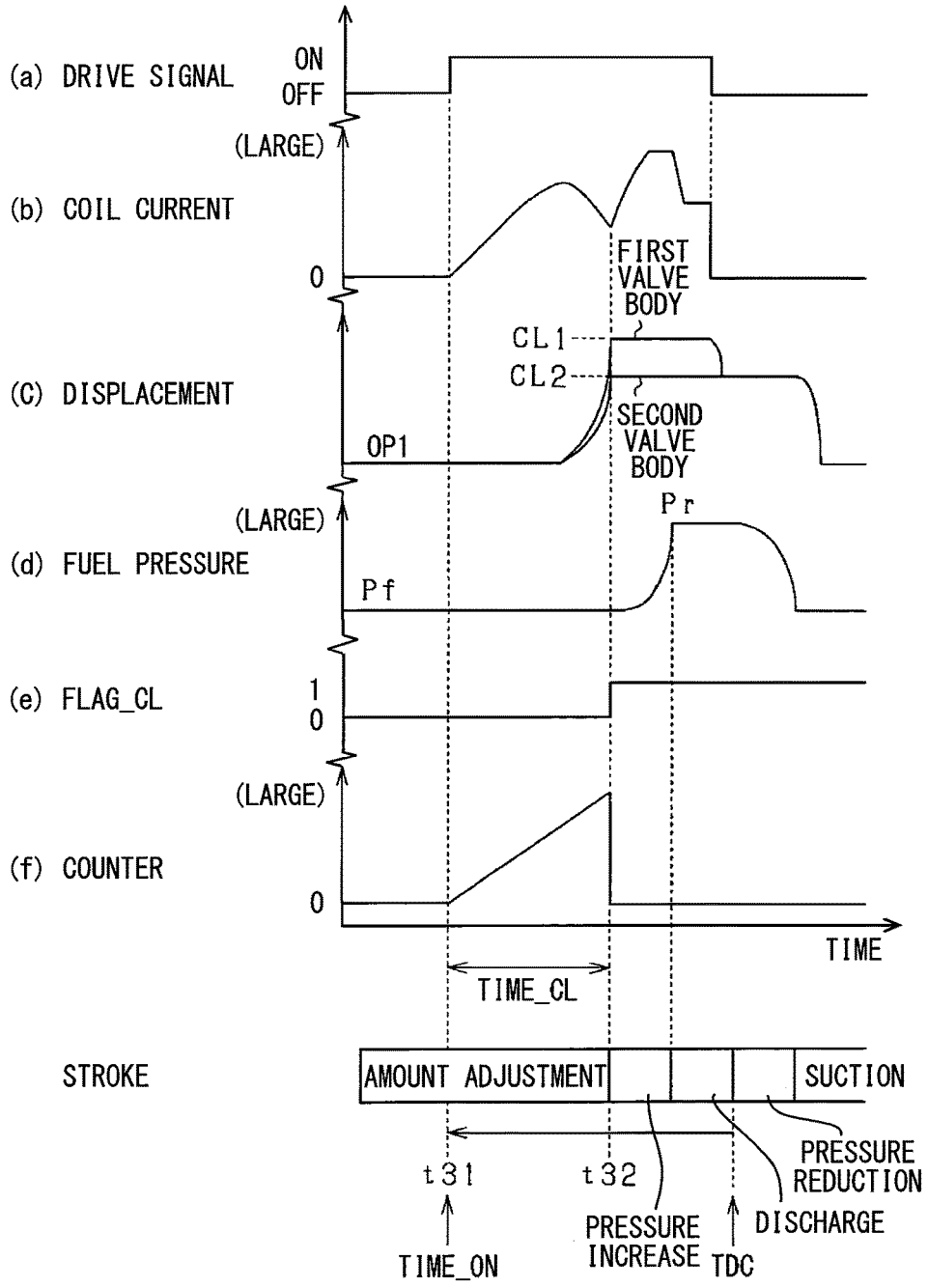
FIG. 6 is a time chart of an energization start timing calculation process.

The energization start timing computation process of this embodiment will be described by using a time chart in FIG. 6. In FIG. 6, (a) indicates a relationship between the drive signal of the control valve 30 and time, (b) indicates a relationship between the current flowing through the coil 33 and time, (c) indicates relationships between displacements of the first valve body 34 and the second valve body 37 from the valve opening positions and time, (d) indicates a relationship between the fuel pressure in the pressurizing chamber 25 and time, (e) indicates a relationship between the valve closing determination flag FLAG_CL and time, and (f) indicates a relationship between a valve closing time counter COUNTER and time. Regarding the valve closing time counter COUNTER, in this embodiment, a timer is provided in the ECU 50 for measurement.

In FIG. 6, in conjunction with the switching of the drive signal of the control valve 30 to ON (the valve closing command) by the microcomputer at timing t31, the valve closing time counter COUNTER starts counting up. In parallel with this, the microcomputer determines whether to permit the actuation of the high-pressure pump 20 by the above pump actuation determination process. When the valve closing determination flag FLAG_CL is switched from 0 to 1, the microcomputer sets the valve closing time counter COUNTER to the valve closing required time TIME_CL at switching timing t32 and stores this in the memory. During the actuation of the pump for pressure-feeding the fuel next time, the microcomputer uses the stored valve closing required time TIME_CL to compute the energization start timing.

In this embodiment, the actual valve closing required time is measured by the valve closing time counter COUNTER at every actuation of the pump, and the valve closing required time TIME_CL is updated on the basis of the measured value. However, update timing of the valve closing required time TIME_CL is not limited to the above. For example, the valve closing required time TIME_CL may be updated at every predetermined time or may be updated at every predetermined travel distance.

Next, a process procedure of the energization start timing computation process will be described by using a flowchart in FIG. 7. The energization start timing computation process is executed by the microcomputer of the ECU 50 at predetermined intervals.

Figure 7:
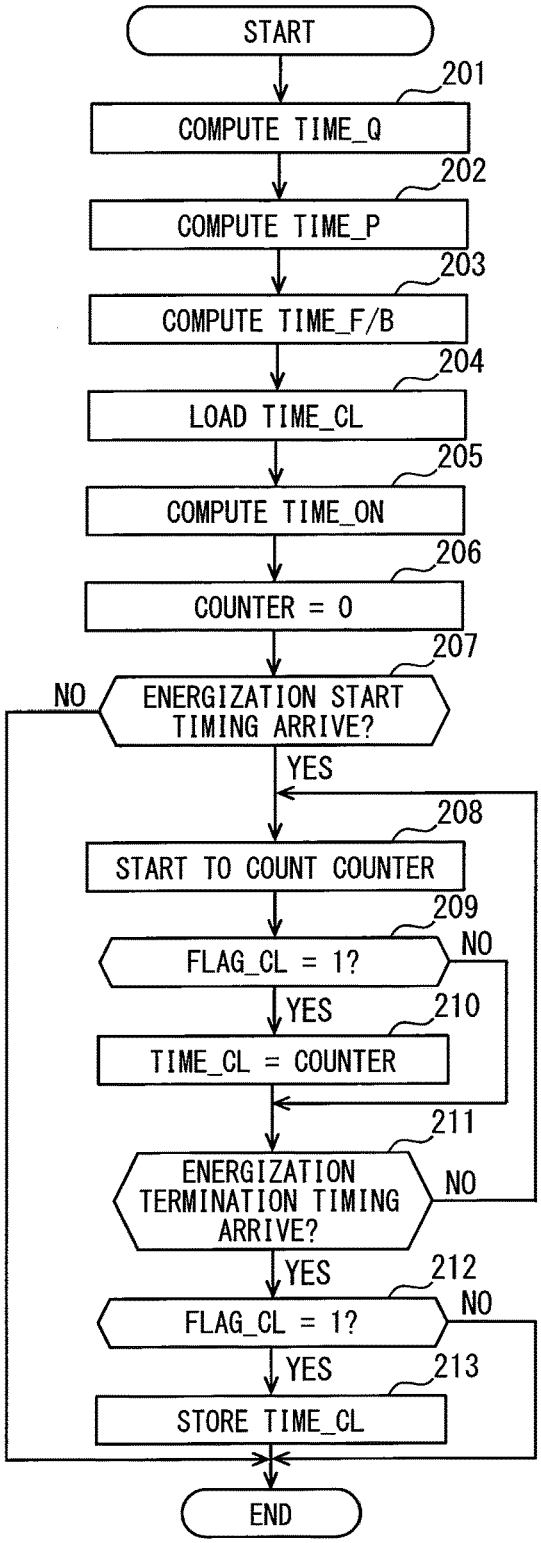
FIG. 7 is a time chart of the energization start timing calculation process.

In FIG. 7, in 201, the microcomputer computes the requested discharge amount of the high-pressure pump 20 on the basis of the fuel injection amount of the injector 15 and also computes the discharge time TIME_Q on the basis of the computed requested discharge amount. In 202, the microcomputer computes the target fuel pressure that is a target value of the fuel pressure in the pressure accumulator chamber 14 and also computes the pressure increase time TIME_P on the basis of the target fuel pressure. In 203, based on the deviation of the actual fuel pressure detected by the fuel pressure sensor 52 from the target fuel pressure, the microcomputer computes the fuel pressure F/B correction amount TIME_F/B. In 204, the microcomputer loads the valve closing required time TIME_CL from the memory. In 205, the microcomputer computes the energization start timing TIME_ON on the basis of the above equation (1). In this embodiment, the process in 205 corresponds to a timing computation section.

In 206, the microcomputer resets the valve closing time counter COUNTER to 0. In 207, the microcomputer determines whether the energization start timing of the coil 33 arrives. When the microcomputer determines that the energization start timing arrives, the process proceeds to 208, and the valve closing time counter COUNTER starts counting up. In 209, the microcomputer determines whether the valve closing determination flag FLAG_CL is 1.

When the microcomputer determines that FLAG_CL is 0, the process proceeds to 211, and it is determined whether the energization termination timing of the coil 33 arrives. When it is time before the energization termination timing arrives, the microcomputer repeats the processes in 208 to 211. When the microcomputer determines that FLAG_CL is 1, the process proceeds to 210, and a value of the valve closing time counter COUNTER is set to the valve closing required time TIME_CL. In this embodiment, the process in 210 corresponds to a time computation section. Thereafter, when the energization termination timing arrives, a positive determination is made in 211, the process proceeds to 212, and the microcomputer determines whether the valve closing determination flag FLAG_CL is 1. At this time, when the microcomputer determines that FLAG_CL is 0, this routine is terminated as is. When it is determined that FLAG_CL is 1, the process proceeds to 213. The microcomputer stores the valve closing required time TIME_CL in the memory and updates the valve closing required time TIME_CL. Then, the microcomputer terminates this routine.

Next, a description will be made on an abnormality diagnosis section that corresponds to an abnormality diagnosis process of the high-pressure pump 20 by using the detection result of the movement detection section by using FIG. 8. The abnormality diagnosis process is executed by the microcomputer of the ECU 50 at predetermined intervals.

Figure 8:
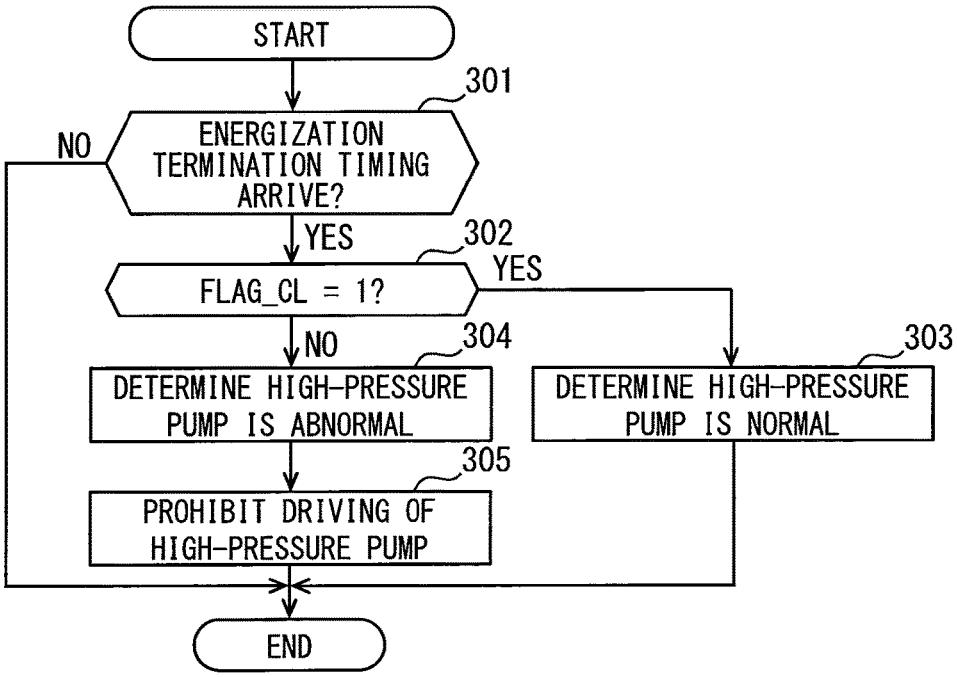
FIG. 8 is a flowchart of a pump abnormality diagnosis process of the first embodiment.

In FIG. 8, the microcomputer determines in 301 whether the energization termination timing of the coil 33 arrives. When it is the time before the energization termination timing arrives, the microcomputer terminates this routine as is. When the energization termination timing arrives, the microcomputer advances the process to 302. The microcomputer determines in 302 whether the valve closing determination flag FLAG_CL is 1. When it is determined that FLAG_CL is 1, the process proceeds to 303, and the microcomputer determines that the high-pressure pump 20 is normal. When it is determined that FLAG_CL is 0, the process proceeds to 304, and the microcomputer determines that the high-pressure pump 20 is abnormal. In 305, the microcomputer prohibits driving of the high-pressure pump 20. In this embodiment, the processes in 301 to 305 correspond to the abnormality diagnosis section.

According to this embodiment that has been described in detail so far, following superior effects are obtained.

When the first valve body 34 and the second valve body 37 show the normal movement with respect to the drive command of the valve opening/valve closing of the control valve 30, the high-pressure pump 20 is actuated, and the fuel is discharged from the high-pressure pump 20. On the other hand, when the first valve body 34 and the second valve body 37 do not show the normal movement with respect to the drive command, the high-pressure pump 20 is not actuated, and the fuel is not discharged from the high-pressure pump 20. Attention is focused on this point. In the above configuration, the movement of the valve body with respect to the drive command of the valve opening or the valve closing of the control valve 30 is monitored, and the actuation state of the high-pressure pump 20 is determined from the movement of the valve body. Thus, the actuation state of the high-pressure pump 20 can accurately be comprehended.

In this embodiment, the movement of the valve body with respect to the drive command of the valve opening or the valve closing of the control valve 30 is detected by detecting the change in the current that flows through the coil 33. Accordingly, the current sensor 54 for detecting the current that flows through the coil 33 only needs to be provided, and the control device can be realized by a low-cost and relatively simple configuration. In addition, because the switching between the increased tendency and the reduced tendency of the current which is generated when the high-pressure pump 20 is actuated appears clearly, detection accuracy can also be improved.

In this embodiment, the valve closing required time TIME_CL that is required until the second valve body 37 is seated on the valve seat 40 from time at which the valve closing of the control valve 30 is commanded is actually measured on the basis of the change in the coil current, and the energization start timing of the control valve 30 is computed on the basis of the measured time. When the valve closing required time TIME_CL differs, the fuel discharge amount of the high-pressure pump 20 is changed, and the fuel pressure control may be influenced by the change. According to the above description, the energization start timing can be computed from the valve closing required time TIME_CL to which an individual difference, the change over time, and the like are reflected. In this way, controllability of the fuel pressure control can be increased. In addition, the actual valve closing timing is comprehended by detecting the movement of the valve body with respect to the drive command, and the valve closing required time TIME_CL is computed on the basis of this. Thus, the actual valve closing required time TIME_CL can accurately be computed.

Movement diagnosis of the high-pressure pump 20 is executed on the basis of the detection result of the movement of the valve body with respect to the drive command of the valve opening or the valve closing of the control valve 30. Thus, the abnormality of the high-pressure pump 20 can accurately be comprehended, and an appropriate measure can be taken during the abnormality of the pump.

Second Embodiment

Next, a second embodiment will be described. In the above first embodiment, the movement of the valve body is detected by detecting the change in the coil current with respect to the drive command of the valve opening/valve closing of the control 30. Meanwhile, in this embodiment, the movement of the valve body is detected by detecting a change in the voltage that is applied to the coil 33. Hereinafter, a description will be centered on differences from the first embodiment.

Figure 9:
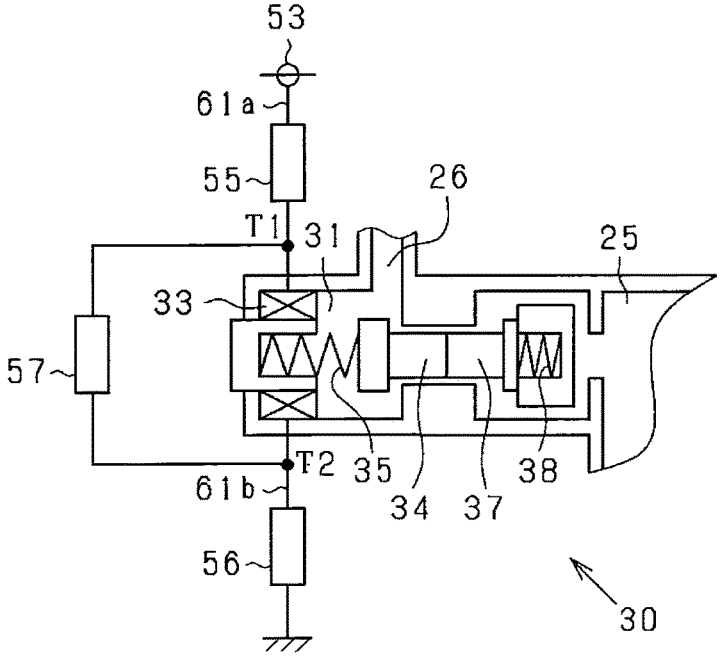
FIG. 9 is a view of a schematic configuration of a control valve of a second embodiment.

A configuration of a fuel supply system of this embodiment is basically the same as that of the above first embodiment, but differs from the above first embodiment in a point that voltage sensors 55 to 57 are provided instead of the current sensor 54. In detail, as depicted in FIG. 9, the fuel supply system includes: the first voltage sensor 55 that is disposed in a first path 61*a* for connecting a power supply 53 and a coil 33; the second voltage sensor 56 that is disposed in a second path 61*b* for connecting the coil 33 and a ground point; and the third voltage sensor 57 for detecting a voltage between an input terminal T1 and an output terminal T2 of the coil 33. Although not depicted, a switch is provided in the middle of each of the first path 61*a* and the second path 61*b*, and the energization/non-energization of the coil 33 can be switched. Detection signals of the voltage sensors 55 to 57 are each input to an ECU 50. In this embodiment, the detection signal of the first voltage sensor 55 corresponds to a first voltage, the detection signal of the second voltage sensor 56 corresponds to a second voltage, and the detection signal of the third voltage sensor 57 corresponds to a third voltage.

Next, a pump actuation determination of this embodiment will be described by using a time chart in FIG. 10. In this embodiment, attention is focused on the movement of a first valve body 34 with respect to the switching of a drive command between the valve closing and the valve opening of a control valve 30 that appears as the change in the voltage applied to the coil 33. By indirectly detecting the movement of the valve body on the basis of the change in the voltage, whether to permit the actuation of a high-pressure pump 20 is determined.

Figure 10:
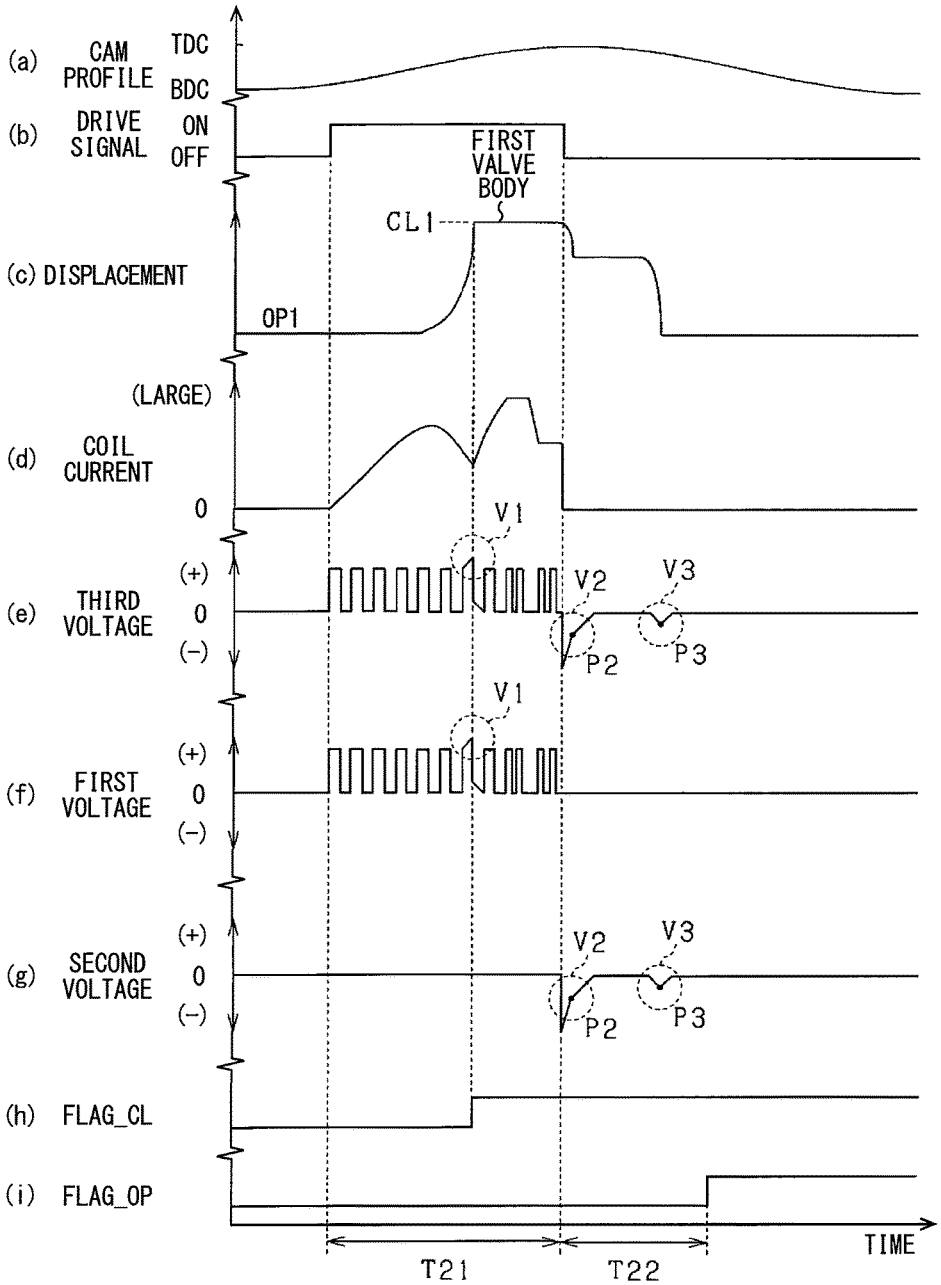
FIG. 10 is a time chart for depicting relationships between detected voltages of first to third voltage sensors and time.

More specifically, as depicted in FIG. 10, in an ON period T21 of the drive signal of the control valve 30, a microcomputer monitors the voltage detected by the third voltage sensor 57 and determines whether a behavior V1 in which a change amount of the voltage as a change width of the voltage becomes at least equal to a predetermined value appears separately from the voltage change by the duty control. In a period T22 from the switching of the drive signal to OFF until a lapse of a predetermined time, the voltage detected by the third voltage sensor 57 is monitored, and, for example, bending points P2, P3 of the voltage are detected as changes in the voltage that appear by the change in the inductance. In this embodiment, the bending points P2, P3 respectively correspond to behaviors V2, V3. When all of the behaviors V1 to V3 are detected, the first valve body 34 shows the normal movement with respect to the drive command. Thus, such a determination that the high-pressure pump 20 is actuated is made. On the other hand, when at least one of the behaviors V1 to V3 is not detected, the first valve body 34 does not show the normal movement with respect to the drive command. Thus, such a determination that the high-pressure pump 20 is not actuated normally is made.

The behavior V1 can also be detected by the first voltage sensor 55, and the behaviors V2 and V3 can also be detected by the second voltage sensor 56. Accordingly, such a configuration may be adopted that all of sensor detection values of the first voltage sensor 55 to the third voltage sensor 57 are used to determine that all of the behaviors V1 to V3 are detected. In this case, determination accuracy can be increased by confirming the behaviors V1 to V3 by the multiple sensors.

Next, a process procedure of a pump actuation determination process of this embodiment will be described by using a flowchart in FIG. 11. The pump actuation determination process is executed by the microcomputer of the ECU 50 at predetermined intervals.

Figure 11:
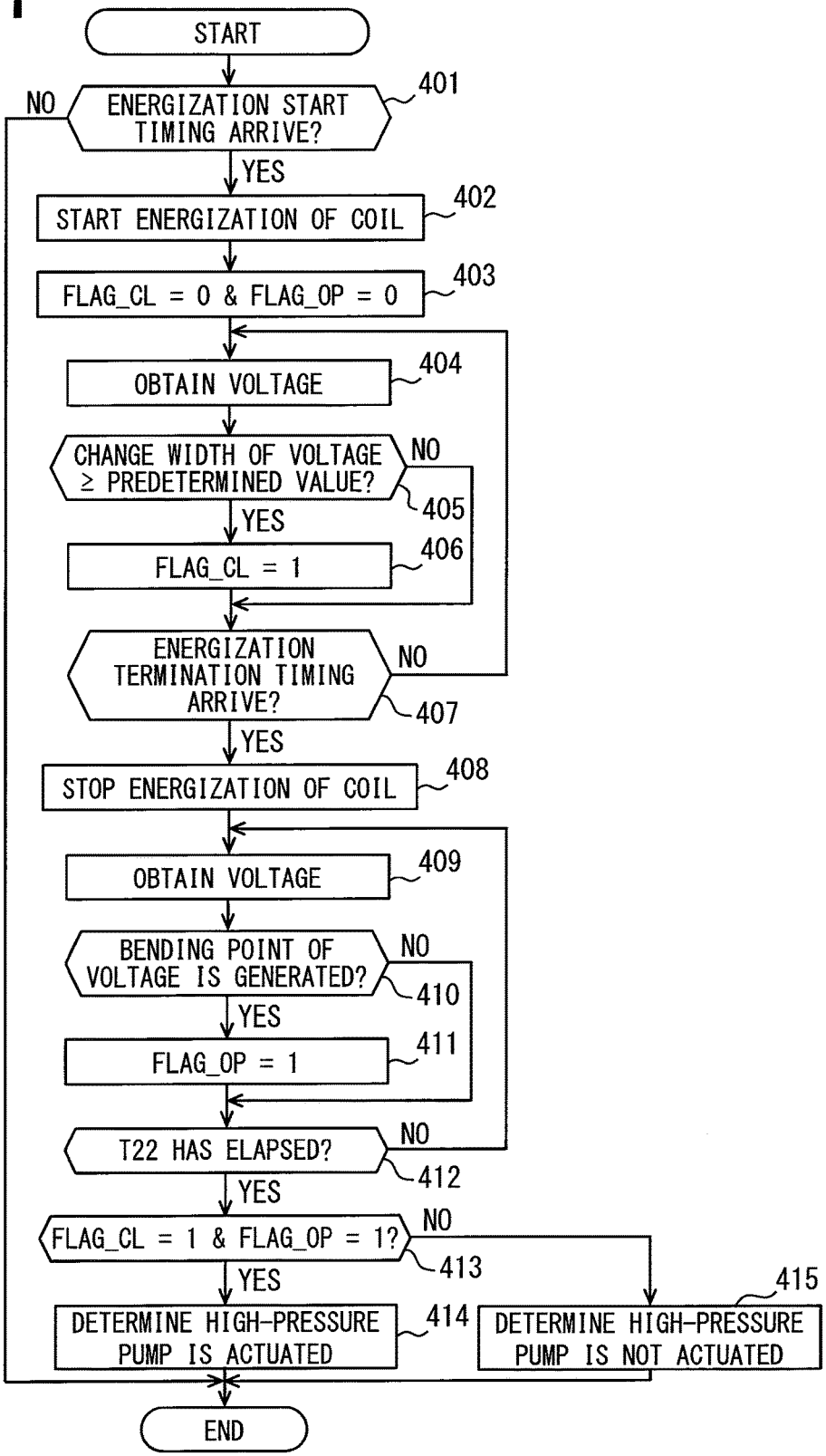
FIG. 11 is a flowchart of a pump actuation determination process of the second embodiment.

In FIG. 11, the microcomputer determines in 401 whether the energization start timing of the coil 33 arrives. When the energization start timing arrives, the process proceeds to 402, and the microcomputer commands the valve closing of the control valve 30 and energizes the coil 33. In 403, the microcomputer resets a valve closing determination flag FLAG_CL and a valve opening determination flag FLAG_OP to 0. The valve opening determination flag FLAG_OP is a flag for indicating that the control valve 30 is in the valve opened state. When the microcomputer determines that the control valve 30 is in the valve opened state, the valve opening determination flag FLAG_OP is set to 1.

In 404, the microcomputer obtains the voltage value that is detected by the third voltage sensor 57. In 405, the microcomputer determines whether the change width of the voltage from which a pulse change is eliminated is at least equal to the predetermined value. The microcomputer computes the change width of the voltage as the change amount of the voltage from a time point at which a change of the voltage detected by the third voltage sensor 57 to an increased side or a reduced side is observed, for example. When the change width of the voltage is smaller than the predetermined value, the microcomputer does not execute the process in 406 and advances the process to 407. When the change width of the voltage is at least equal to the predetermined value, the process proceeds to 406, the microcomputer sets the valve closing determination flag FLAG_CL to 1, and the process proceeds to 407.

The microcomputer determines in 407 whether the energization termination timing for terminating the energization of the coil 33 arrives. When the energization termination timing arrives, the process proceeds to 408. The microcomputer outputs the valve opening command of the control valve 30 and stops the energization of the coil 33.

In 409, the microcomputer obtains the voltage that is detected by the third voltage sensor 57. The microcomputer determines in 410 whether the bending point of the voltage is generated. When the microcomputer determines that the bending point of the voltage is not generated, the process in 411 is not executed, and the process proceeds to 412. When the microcomputer determines that the bending point of the voltage is generated, the process proceeds to 411, the valve opening determination flag FLAG_OP is set to 1, and the process proceeds to 412. In this embodiment, a positive determination is made in 410 when both of the bending points P2, P3 are detected. However, it may be configured that the positive determination is made in 410 when either one of the bending points P2, P3 is detected. In this embodiment, the processes in 403, 405, 406, 410, and 411 correspond to a movement detection section.

The microcomputer determines in 412 whether the predetermined time T22 has elapsed since the energization termination timing of the coil 33. When a negative determination is made, the microcomputer executes the processes in 409 to 412. When the predetermined time T22 has elapsed since the energization termination timing of the coil 33 and thus the positive determination is made in 412, the process proceeds to 413, and the microcomputer loads the valve closing determination flag FLAG_CL and the valve opening determination flag FLAG_OP and determines whether both of these flags FLAG_CL, FLAG_OP are 1. When it is determined that both of FLAG_CL and FLAG_OP are 1, the process proceeds to 414, and the microcomputer determines that the high-pressure pump 20 is actuated normally. When at least either one of FLAG_CL and FLAG_OP is 0, the process proceeds to 415, and the microcomputer determines that the high-pressure pump 20 is not actuated. In this embodiment, the processes in 413, 414, and 415 correspond to an actuation determination section. Then, the microcomputer terminates this routine.

Next, a description will be made on an abnormality diagnosis process of the high-pressure pump 20 by using the detection result of the movement detection section by using FIG. 12. The abnormality diagnosis process is executed by the microcomputer of the ECU 50 at predetermined intervals.

Figure 12:
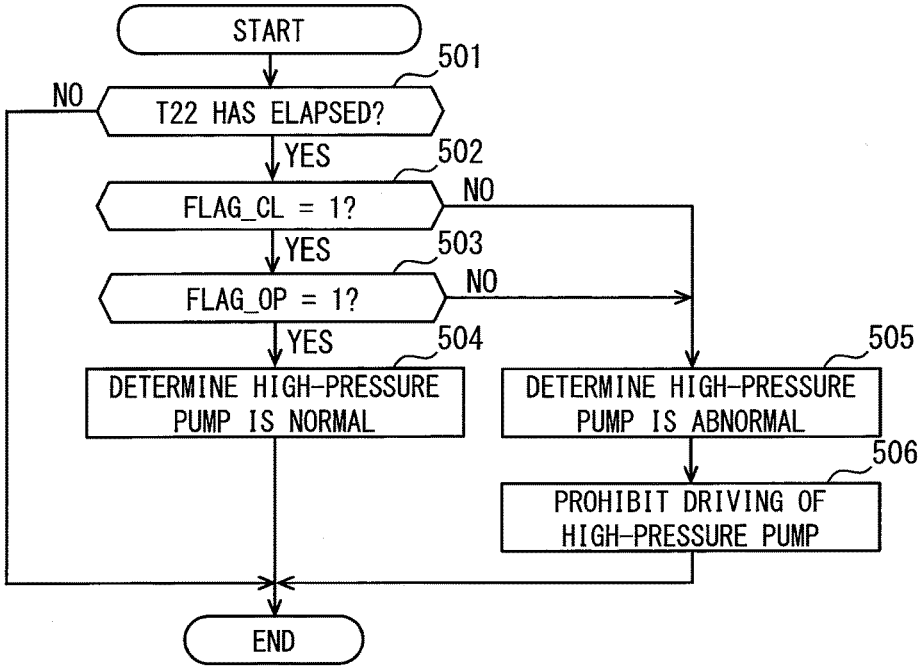
FIG. 12 is a flowchart of a pump abnormality diagnosis process of the second embodiment.

In FIG. 12, the microcomputer determines in 501 whether the predetermined time T22 has elapsed since the energization termination timing of the coil 33. When it is time before a lapse of the predetermined time T22 from the energization termination timing, the microcomputer terminates this routine as is. When it is time after the lapse of the predetermined time T22 from the energization termination timing, the microcomputer advances the process to 502. The microcomputer determines in 502 whether the valve closing determination flag FLAG_CL is 1. The microcomputer determines in 503 whether the valve opening determination flag FLAG_OP is 1. When a positive determination is made in 502 and a positive determination is made in 503, the process proceeds to 504, and the microcomputer determines that the high-pressure pump 20 is normal.

When a negative determination is made in 502 or a negative determination is made in 503, the process proceeds to 505, and the microcomputer determines that the high-pressure pump 20 is abnormal. In 506, the microcomputer prohibits the driving of the high-pressure pump 20. In this embodiment, the processes in 501 to 506 correspond to an abnormality diagnosis section.

In the second embodiment that has been described in detail so far, the movement of the valve body with respect to the drive command of the valve opening or the valve closing of the control valve 30 is detected by detecting the change in the voltage that is applied to the coil 33. Thus, the voltage sensor (the third voltage sensor 57) only needs to be provided. Therefore, the control device can be realized by a low-cost and relatively simple configuration.

Third Embodiment

Next, a third embodiment will be described. In this embodiment, a displacement sensor for detecting displacement of a valve body of a control valve 30 is provided. By detecting the displacement of the valve body by the displacement sensor, the movement of the valve body with respect to a drive command of the valve opening or the valve closing is detected. In addition, an actuation determination of a high-pressure pump 20 is made on the basis of a detection result. Hereinafter, a description will be centered on differences from the first embodiment and the second embodiment.

Figure 13:
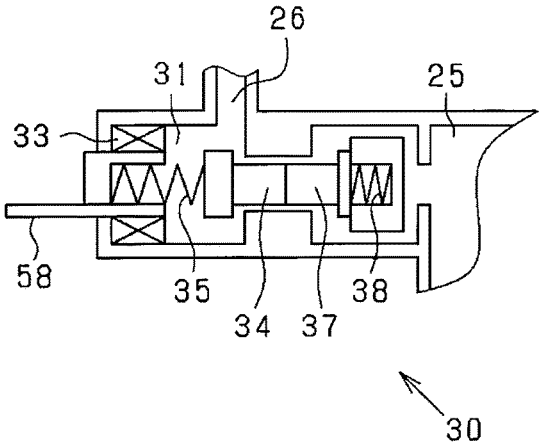
FIG. 13 is a view of a schematic configuration of a control valve of a third embodiment.

A configuration of a fuel supply system of this embodiment is basically the same as that of the above first embodiment but, as depicted in FIG. 13, differs from the above first embodiment in a point that a displacement sensor 58 for detecting displacement of a first valve body 34 is provided instead of the current sensor 54. That is, in this embodiment, the movement of the first valve body 34 with respect to the switching of the drive command between the valve closing and the valve opening of the control valve 30 is directly detected, and a determination of whether to permit the actuation of the high-pressure pump 20 is made on the basis of the detected displacement. The displacement sensor 58 is provided at a position to oppose an end of the first valve body 34 and can detect a separation distance with respect to the valve closing position (the abutment position against a first stopper 36). A detection signal of the displacement sensor 58 is input to an ECU 50.

Figure 14:
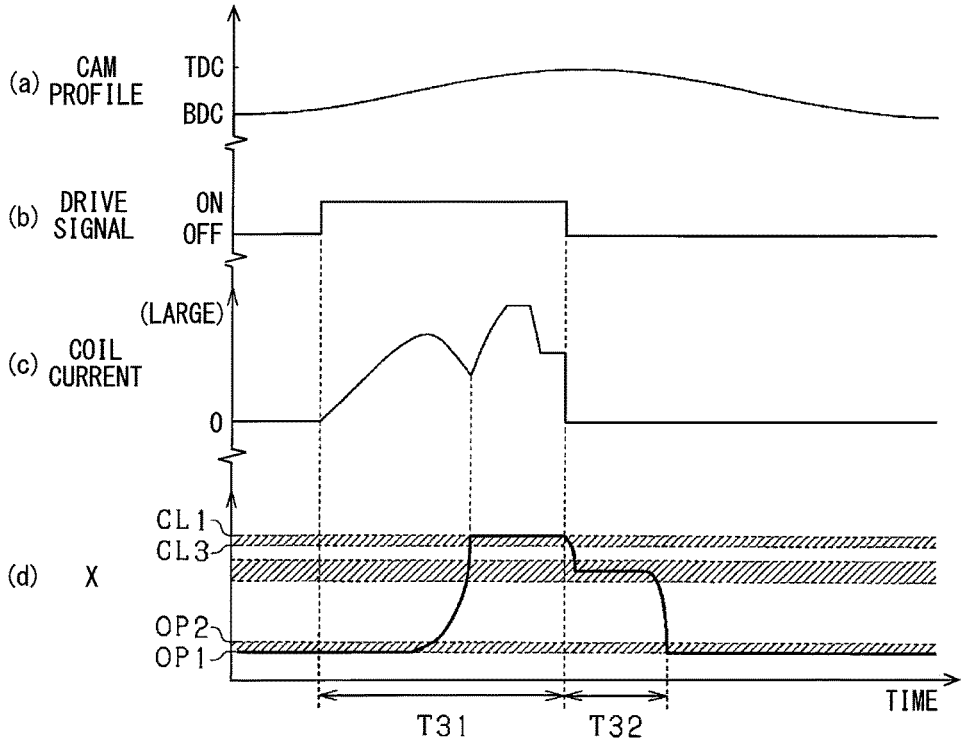
FIG. 14 is a time chart of a pump actuation determination process of the third embodiment.

A pump actuation determination of this embodiment will be described by using a time chart in FIG. 14. In this embodiment, the movement of the first valve body 34 at a time that the high-pressure pump 20 is actuated normally is taken into consideration. In an ON period T31 of the drive signal of the control valve 30, displacement X of the first valve body 34 is monitored by the displacement sensor 58, and it is determined whether the displacement X of the first valve body 34 falls within a predetermined range that includes a valve closing position CL1. In a period T32 from the switching of the drive signal to OFF until a lapse of a predetermined time, the displacement X of the first valve body 34 is monitored by the displacement sensor 58, and it is determined whether the displacement X of the first valve body 34 falls within a predetermined range that includes a valve opening position OP1. When both of a determination result of the period T31 and a determination result of the period T32 are positive, such a determination that the high-pressure pump 20 is actuated is made. On the other hand, when at least either one of the determination result of the period T31 and the determination result of the period T32 is negative, such a determination that the high-pressure pump 20 is not actuated is made.

Figure 15:
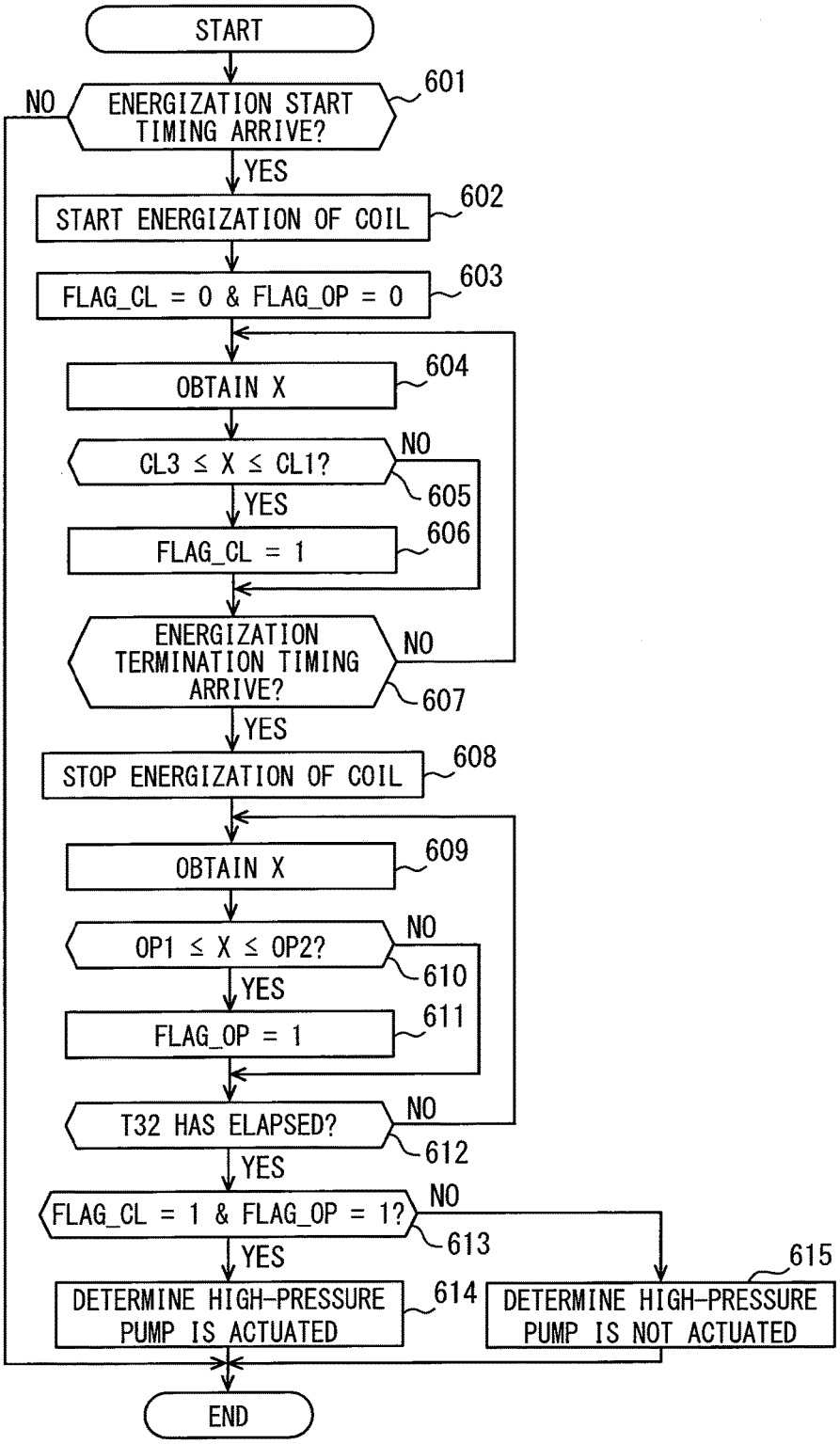
FIG. 15 is a flowchart of the pump actuation determination process of the third embodiment.

Next, a process procedure of a pump actuation determination process of this embodiment will be described by using a flowchart in FIG. 15. The pump actuation determination process is executed by a microcomputer of the ECU 50 at predetermined intervals. In the description of FIG. 15, the description of the processes that are the same as those in above FIG. 11 is not made.

In FIG. 15, in 601 to 603, the microcomputer executes the same processes as 401 to 403 in above FIG. 11. In 604, the microcomputer obtains the displacement X of the first valve body 34 that is detected by the displacement sensor 58. The microcomputer determines in 605 whether the displacement X is within a valve closing determination region that is a region between the valve closing position CL1 (the abutment position against the first stopper 36) and a position CL3 that is separated from the first stopper 36 by a predetermined distance. When the microcomputer determines that the displacement X is not within the valve closing determination region, the process in 606 is not executed, and the process proceeds to 607. When the microcomputer determines that the displacement X is within the valve closing determination region, the process proceeds to 606, a valve closing determination flag FLAG_CL is set to 1, and the process proceeds to 607.

In 607 and S608, the microcomputer executes the same processes as 407 and 408. In 609, the microcomputer obtains the displacement X of the first valve body 34 that is detected by the displacement sensor 58. The microcomputer determines in 610 whether the displacement X is within a valve opening determination region that is a region between the valve opening position OP1 (a maximum displaceable position in a direction to separate from the first stopper 36) and a position OP2 that is displaced from the valve opening position OP1 to the first stopper 36 side by a predetermined distance. In this embodiment, the valve opening position OP1 is the maximum displaceable position in the direction to separate from the first stopper 36. When the microcomputer determines that the displacement X is not within the valve opening determination region, the process in 611 is not executed, and the process proceeds to 612. On the other hand, when the microcomputer determines that the displacement X is within the valve opening determination region, a valve opening determination flag FLAG_OP is set to 1 in 611, and the process proceeds to 612. In this embodiment, the processes in 603, 605, 606, 610, and 611 correspond to a movement detection section.

The microcomputer determines in 612 whether the predetermined time T32 has elapsed since the energization termination timing of a coil 33. When it is determined that it is time before a lapse of the predetermined time T32, the processes in 609 to 612 are executed. When the predetermined time T32 has elapsed since the energization termination timing of the coil 33 and thus the microcomputer makes a positive determination in 612, the process proceeds to 613, the same processes as 413 to 415 are executed in 613 to 615, and this routine is terminated. In this embodiment, the processes in 613, 614, and 615 correspond to an actuation determination section.

In the third embodiment that has been described in detail so far, the movement of the valve body with respect to the drive command of the valve opening or the valve closing of the control valve 30 is detected by detecting the displacement of the first valve body 34. Thus, the movement of the first valve body 34 with respect to the drive command can directly be monitored, and detection accuracy is high.

Fourth Embodiment

Next, a fourth embodiment will be described. In this embodiment, a vibration sensor for detecting vibrations that are generated when a first valve body 34 and a second valve body 37 of a control valve 30 respectively collide with a first stopper 36 and a second stopper 39 is provided. By detecting the vibrations during collision of the first valve body 34 with the first stopper 36 and collision of the second valve body 37 with the second stopper 39 by the vibration sensor, the movement of the valve body with respect to a drive command of the control valve 30 is detected. In addition, an actuation determination of a high-pressure pump 20 is made on the basis of a detection result. Hereinafter, a description will be centered on differences from the first embodiment to the third embodiment.

Figure 16:
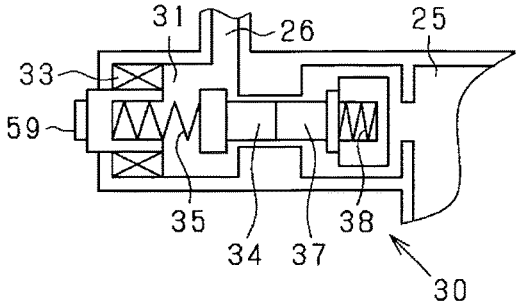
FIG. 16 is a view of a schematic configuration of a control valve of a fourth embodiment.

A configuration of a fuel supply system of this embodiment is basically the same as the above first embodiment but, as depicted in FIG. 16, differs from the above first embodiment in a point that a vibration sensor 59 is attached to a main body of the control valve 30 instead of the current sensor 54. That is, in this embodiment, the movement of the first valve body 34 and the movement of the second valve body 37 with respect to the switching of the drive command between the valve closing and the valve opening of the control valve 30 are indirectly detected by the vibration sensor 59, and a determination of whether to permit the actuation of the high-pressure pump 20 is made on the basis of a detection result. A detection signal of the vibration sensor 59 is input to an ECU 50.

Figure 17:
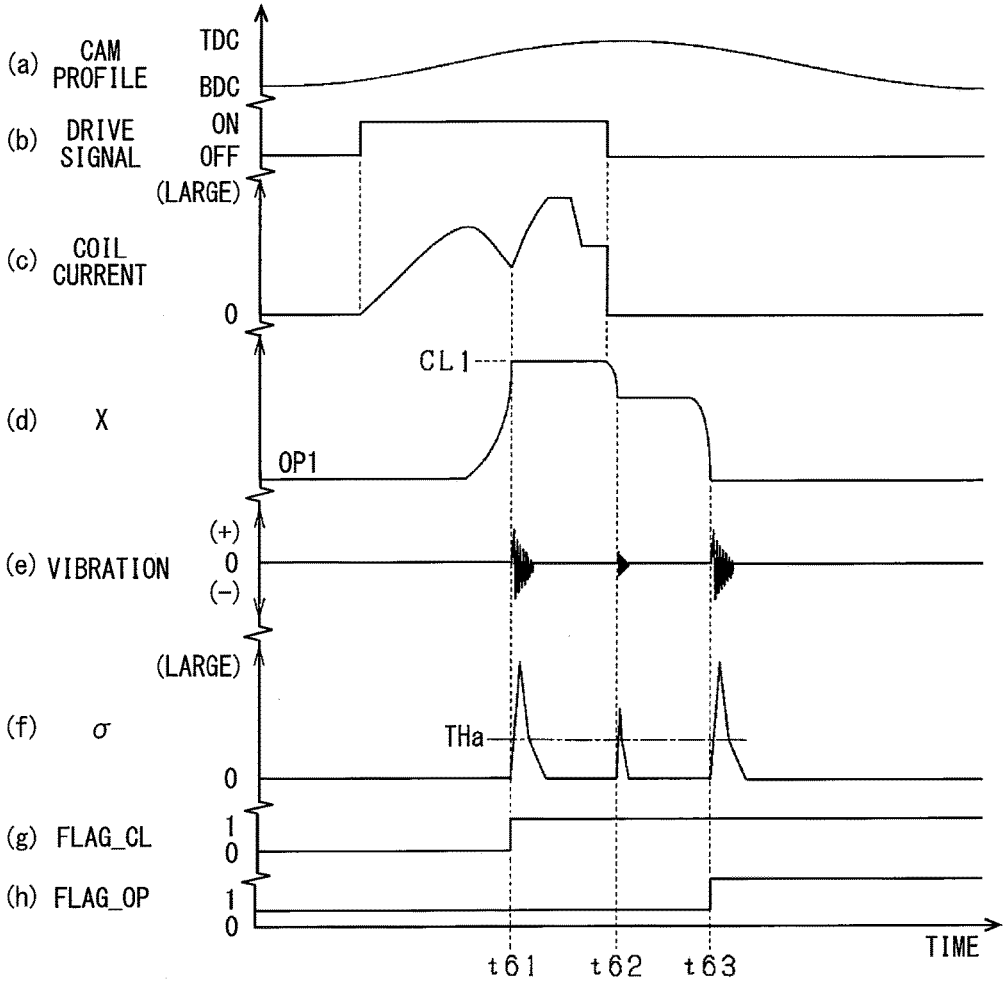
FIG. 17 is a time chart of a pump actuation determination process of the fourth embodiment.

A pump actuation determination of this embodiment will be described by using a time chart in FIG. 17. In this embodiment, a standard deviation σ of a detection value (amplitude) of the vibration sensor 59 is computed, and an actuation determination of the high-pressure pump 20 is made by a comparison between the computed standard deviation σ and a determination value. That is, when the high-pressure pump 20 can be actuated, the first valve body 34 and the second valve body 37 are displaced in conjunction with the drive command of the control valve 30. Accordingly, vibrations are generated at timing t61 at which the first valve body 34 collides with the first stopper 36 in conjunction with the valve closing command, at timing t62 at which the first valve body 34 collides with the second valve body 37 in conjunction with the valve opening command, and timing t63 at which the second valve body 37 collides with the second stopper 39, and the standard deviation σ of the amplitude becomes larger than the determination value. On the other hand, the vibration is not generated when the high-pressure pump 20 is not actuated. Accordingly, the standard deviation σ of the amplitude becomes substantially 0. By using this event, the actuation determination of the high-pressure pump 20 is made.

Figure 18:
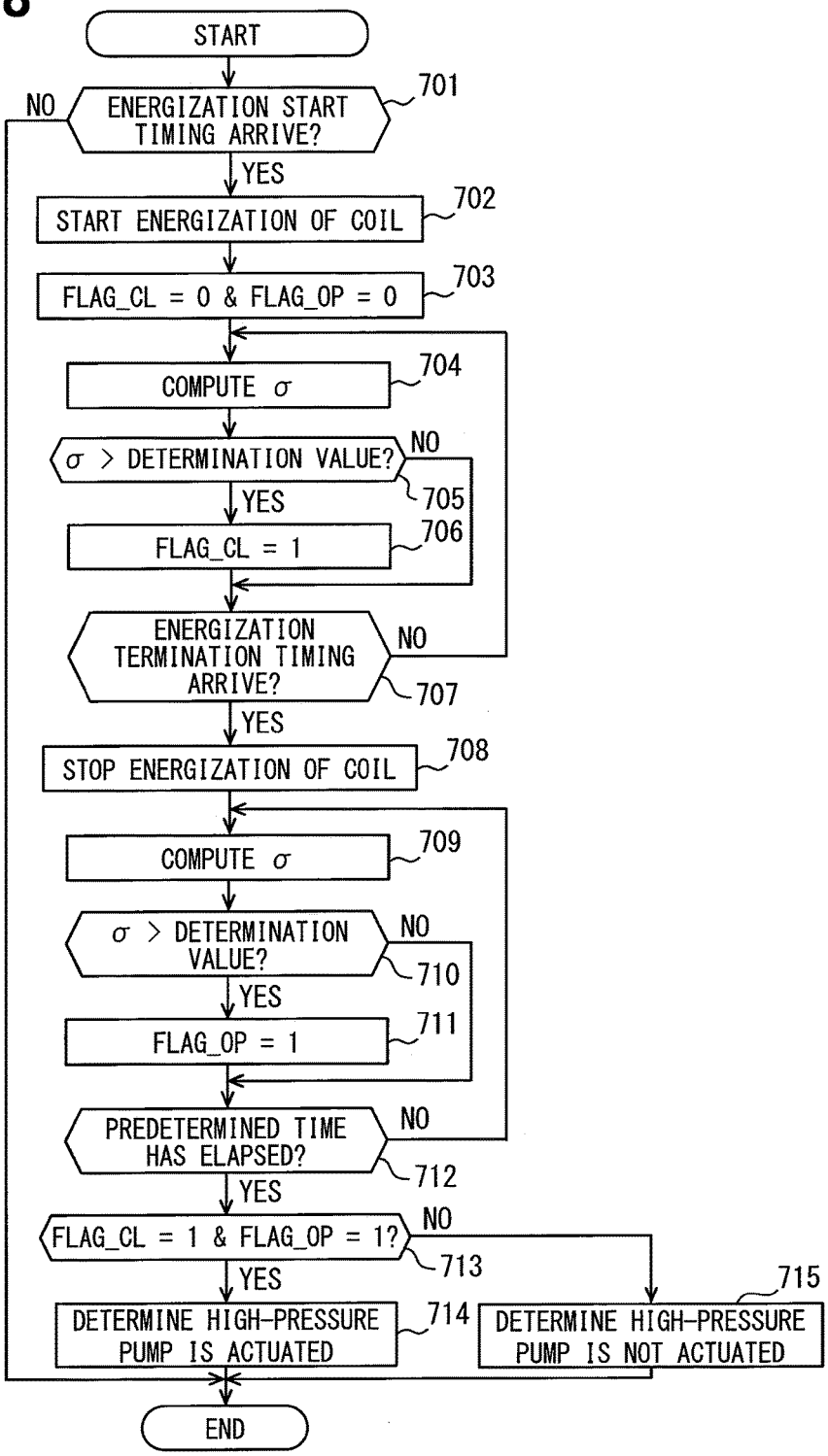
FIG. 18 is a flowchart of the pump actuation determination process of the fourth embodiment.

Next, a process procedure of a pump actuation determination process of this embodiment will be described by using a flowchart in FIG. 18. The pump actuation determination process is executed by a microcomputer of the ECU 50 at predetermined intervals. In the description of FIG. 18, the description of the processes that are the same as those in above FIG. 11 is not made.

In FIG. 18, in 701 to 703, the microcomputer executes the same processes as 401 to 403 in above FIG. 11. In 704, the microcomputer computes the standard deviation σ of the amplitude of the vibration that is detected by the vibration sensor 59. The microcomputer determines in 705 whether the standard deviation σ exceeds the determination value. When the microcomputer determines that the standard deviation σ does not exceed the determination value, the process in 706 is not executed, and the process proceeds to 707. When the microcomputer determines that the standard deviation σ exceeds the determination value, the process proceeds to 706, a valve closing determination flag FLAG_CL is set to 1, and the process proceeds to 707.

In 707 and 708, the microcomputer executes the same processes as 407 to 408. In 709, the microcomputer computes the standard deviation σ of the amplitude that is detected by the vibration sensor 59. The microcomputer determines in 710 whether the standard deviation σ exceeds the determination value. When the microcomputer determines that the standard deviation σ does not exceed the determination value, the process in 711 is not executed, and the process proceeds to 712. When the microcomputer determines that the standard deviation σ exceeds the determination value, the process proceeds to 711, a valve opening determination flag FLAG_OP is set to 1, and the process proceeds to 712. In this embodiment, the processes in 703, 705, 706, 710, and 711 correspond to a movement detection section.

The microcomputer determines in 712 whether a predetermined time has elapsed since the energization termination timing of a coil 33. When the microcomputer determines it is time before a lapse of the predetermined time, the processes in 709 to 712 are executed. As the predetermined time, a time from the energization termination timing to timing between t62 and t63 in FIG. 17 may be set. In this case, the movement of the valve body can be detected on the basis of the vibration at the abutment position. In addition, as the predetermined time, a time from the energization termination timing to timing after t63 may be set. In this case, the movement of the valve body can be detected on the basis of the vibration at the abutment position and the vibration during the collision of the second valve body 37 with the second stopper 39.

When the predetermined time has elapsed since the energization termination timing of the coil 33 and thus the microcomputer makes a positive determination in 712, the process proceeds to 713, the same processes as 413 to 415 are executed in 713 to 715, and this routine is terminated. In this embodiment, the processes in 713, 714, and 715 correspond to an actuation determination section.

In the fourth embodiment that has been described in detail so far, the movement of the valve body with respect to the drive command of the valve opening or the valve closing of the control valve 30 is detected by detecting the vibrations that are generated when the first valve body 34 and the second valve body 37 are displaced. Sound and the vibrations during the collisions of the valve bodies with the first stopper 36 and the second stopper 39 are relatively large, and detection accuracy is high.

Other Embodiments

The present disclosure is not limited to the described contents of the above embodiments but may be implemented as follows, for example.

(a) In the above first embodiment, the change in the current with respect to the drive command of the control valve 30 is detected on the basis of the current speed. However, the configuration for detecting the change in the current is not limited thereto. For example, in the ON period of the drive signal, a maximum value of the measured value of the current is held, and a change amount of a measurement value of this time with respect to the held value is computed. Then, the change in the current is detected on the basis of the computed change amount.

Figure 19:
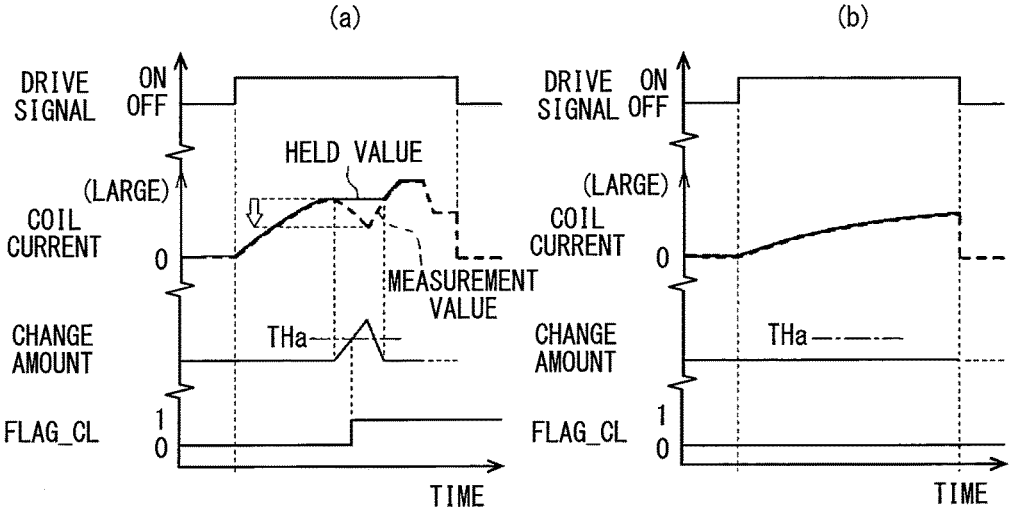
FIG. 19 includes time charts of a pump actuation determination process of another embodiment.

More specifically, when the high-pressure pump 20 is actuated, the reduced tendency of the coil current is generated in the ON period of the drive signal. Accordingly, as depicted in FIG. 19(*a*), the change amount of the measurement value of this time with respect to the held value is gradually increased in a period in which the reduced tendency of the coil current is generated. On the other hand, when the high-pressure pump 20 is not actuated, the reduced tendency of the coil current is not generated in the ON period of the drive signal. Thus, the change amount of the measurement value of this time with respect to the held value is substantially zero. In consideration of this point, in this embodiment, the change amount of the measurement value of this time with respect to the held value is compared to the determination value. When the change amount is detected to be larger than the determination value, the valve closing determination flag FLAG_CL is set to 1.

(b) In the above first embodiment, the actuation determination of the high-pressure pump 20 is made by detecting the generation of the reduced tendency of the coil current in the ON period of the drive signal. However, in view of a fact that the switching between the increased tendency and the reduced tendency of the current clearly appears as the bending point P1, a configuration for making the actuation determination of the high-pressure pump 20 by detecting shifting of the coil current from the reduced tendency to the increase in the period may be adopted. More specifically, the presence or the absence of the bending point P1 of the current is detected on the basis of the current value that is monitored in the ON period of the drive signal, for example. When the bending point is present, it is determined that the high-pressure pump 20 is in the actuated state. In this configuration, not only the reduced tendency of the coil current, but further shifting to the increased tendency is also detected. Thus, determination accuracy of the movement of the valve body can be increased, and furthermore, accuracy of the actuation determination of the high-pressure pump 20 can be increased.

(c) As a configuration for detecting the shifting of the coil current from the reduced tendency to the increase in the ON period of the drive signal, a configuration for detecting that both conditions including that the current speed falls below the determination value THa (<0) and that the current speed exceeds a determination value THb (<0) are satisfied may be adopted. At this time, the determination value THa and the determination value THb may be the same or differ from each other.

(d) As the configuration for detecting the shifting of the coil current from the reduced tendency to the increase in the ON period of the drive signal, in FIG. 19, a configuration for detecting on the basis of a comparison result between the change amount of the measurement value of this time with respect to the held value as the maximum value and a determination value may be adopted. More specifically, a configuration for detecting that both conditions including that the change amount of the measurement value of this time with respect to the held value exceeds the determination value and that the change amount falls below the determination value are satisfied may be adopted.

(e) In the above second embodiment, the movement of the valve body is detected by using the detection value of the third voltage sensor 57. However, a configuration for detecting the movement of the valve body not by using the detection value of the third voltage sensor 57 but by using at least either one of the detection value of the first voltage sensor 55 and the detection value of the second voltage sensor 56 may be adopted.

(f) In the above second embodiment, the presence or the absence of the behavior V1 is detected in the ON period T21 of the drive signal, and the presence or the absence of the behaviors V2, V3 is detected in the period T22 from the switching from ON to OFF of the drive signal to the lapse of the predetermined time. However, a configuration for making the actuation determination of the high-pressure pump 20 on the basis of the detection result in either one of the period T21 and the period T22 may be adopted.

(g) In the above third embodiment, the displacement of the first valve body 34 is detected by the displacement sensor 58. However, the sensor for detecting the displacement of the valve body is not limited thereto. For example, a contact point sensor is attached to the first stopper 36, an ON signal is outputted when the first valve body 34 abuts against the first stopper 36, and an OFF signal is outputted when the first valve body 34 separates from the first stopper 36. A configuration for detecting the displacement of the valve body by the ON/OFF signal of the contact point sensor may be adopted. Alternatively, a conduction sensor is attached to the valve opening position of the first valve body 34, an ON signal is outputted when the first valve body 34 is held at the valve opening position, and an OFF signal is outputted when the first valve body 34 is displaced from the valve opening position. A configuration for detecting the displacement of the valve body by the ON/OFF signal of the conduction sensor may be adopted.

(h) In the above third embodiment, the sensor for detecting the displacement of the first valve body 34 is provided, and the actuation determination of the high-pressure pump 20 is made on the basis of the displacement detected by the sensor. However, a configuration for providing a sensor for detecting the displacement of the second valve body 37 and making the actuation determination of the high-pressure pump 20 on the basis of the displacement detected by the sensor may be adopted.

(i) In the above third embodiment, a configuration for detecting the displacement of the first valve body 34 to the abutment position after the switching from ON to OFF of the drive signal, so as to detect the movement of the valve body with respect to the drive signal may be adopted. More specifically, in the period T32 in FIG. 14, it is determined whether the displacement X of the first valve body 34 detected by the displacement sensor 58 enters a predetermined region including the abutment position. When it is determined that the displacement X is within the predetermined region, or under a condition that it is determined that the displacement X is within the predetermined region, the valve opening determination flag FLAG_OP is set to 1.

In 607 and 608, the same processes as 407 and 408 are executed. In 609, the displacement X of the first valve body 34 that is detected by the displacement sensor 58 is obtained, and it is determined in 610 whether the displacement X is within the region (the valve opening determination region) between the valve opening position OP1 (the maximum displaceable position in the direction to separate from the first stopper 36) and the position OP2 that is displaced from the valve opening position OP1 to the first stopper 36 side by the predetermined distance. When it is determined that the displacement X is not within the valve opening determination region, the process in 611 is not executed, and the process proceeds to 612. On the other hand, when it is determined that the displacement X is within the valve opening determination region, the valve opening determination flag FLAG_OP is set to 1 in 611, and the process proceeds to 612.

(j) In the above fourth embodiment, the movement of the valve body with respect to the drive command is detected on the basis of the standard deviation σ of the amplitude of the vibration that is detected by the vibration sensor 59. However, a configuration for detecting the movement of the valve body with respect to the drive command on the basis of a comparison result between the amplitude and a determination value may be adopted. At this time, when the amplitude (>0) is larger than the determination value, the valve closing determination flag FLAG_CL or the valve opening determination flag FLAG_OP is switched to 1. Alternatively, a configuration for computing an integral value of the amplitude per vibration and detecting the movement of the valve body with respect to the drive command on the basis of the computed integral value may be adopted. At this time, the integral value and the determination value are compared. When the integral value is larger than the determination value, the valve closing determination flag FLAG_CL or the valve opening determination flag FLAG_OP is switched to 1.

(k) In the above embodiments, the reduction speed of the current that flows through the coil 33 is accelerated by applying the voltage in the reverse direction to the coil 33 immediately after the switching from ON to OFF of the drive signal of the control valve 30. However, when a circuit (a flyback circuit) for executing such a process is not provided, the actuation determination of the pump 20 can be made on the basis of the change in the coil current after the switching from ON to OFF of the drive signal. More specifically, in the case where the flyback circuit is not provided, a projected bending point appears to the coil current when the first valve body 34 abuts against the second valve body 37 and when the second valve body 37 abuts against the second stopper 39. Thus, a configuration for making the actuation determination of the high-pressure pump 20 by detecting presence or absence of these bending points may be adopted.

(l) In the above embodiments, the movement of the valve body with respect to the drive command is detected by detecting any one of the change in the current flowing through the coil 33, the change in the voltage applied to the coil 33, the displacement amount of the valve body, and the vibration of the control valve 30. However, a configuration for detecting the movement of the valve body with respect to the drive command by detecting two or more of these may be adopted. For example, in the case where it is detected that a speed (a differential value) of the current value detected by the current sensor 54 falls below the determination value THa and that the change width of the voltage value detected by the voltage sensor 57 is at least equal to a predetermined value in the ON period of the drive signal of the control valve 30, the valve closing determination flag FLAG_CL is set to 1. On the other hand, in the case where either that the speed (the differential value) of the current value detected by the current sensor 54 falls below the determination value THa or that the change width of the voltage value detected by the voltage sensor 57 is at least equal to a predetermined value is not detected, the valve closing determination flag FLAG_CL remains 0.

(m) In the above second embodiment, the above third embodiment, and the above fourth embodiment, similar to the above first embodiment, the energization start timing computation process may be executed by using the valve closing determination flag FLAG_CL that is set in the pump actuation determination process. In addition, in the above third embodiment and the above fourth embodiment, similar to the above first embodiment or the above second embodiment, the abnormality diagnosis process may be executed by using the valve closing determination flag FLAG_CL and the valve opening determination flag FLAG_OP that are set in the pump actuation determination process.

(n) In the above embodiments, a case where the present disclosure is applied to the fuel supply system that includes the control valve 30 having the two valve bodies (the first valve body 34 and the second valve body 37) has been described. However, the present disclosure may be applied to a fuel supply system that includes a control valve having only one valve body. More specifically, the present disclosure is applied to a system having a valve body configured that the control valve is disposed as the valve body in a fuel suction passage that communicates with a pressurizing chamber, can be displaced in an axial direction by switching between energization and non-energization of the coil 33, and supplies/blocks fuel to/from the pressurizing chamber in conjunction with displacement. Also in this configuration, the movement of the valve body with respect to the drive command can be detected on the basis of at least one of the change in the current flowing through the coil 33, the change in the voltage applied to the coil 33, the displacement amount of the valve body, and the vibration of the control valve 30. Thus, the actuation determination of the high-pressure pump 20 can be made on the basis of the movement.

(o) In the above embodiments, the gasoline engine is used as the internal combustion engine. However, a configuration for using a diesel engine may be adopted. That is, the present disclosure may be embodied as a control device for a common rail type fuel supply system of the diesel engine.

While the present disclosure has been described with reference to embodiments thereof, it is to be understood that the disclosure is not limited to the embodiments and constructions. The present disclosure is intended to cover various modification and equivalent arrangements. In addition, while the various combinations and configurations, other combinations and configurations, including more, less or only a single element, are also within the spirit and scope of the present disclosure.

The invention claimed is:

1. A control device that is applied to a high-pressure pump including: a plunger that reciprocates in conjunction with rotation of a rotational shaft so as to be able to change a volume of a pressurizing chamber; and a control valve that has a valve body disposed in a fuel suction passage that communicates with the pressurizing chamber and supplies/blocks fuel to/from the pressurizing chamber by displacing the valve body in an axial direction by energization control with respect to an electromagnetic section, and the control device for the high-pressure pump adjusting a fuel discharge amount of the high-pressure pump by switching a valve opening and a valve closing of the control valve by the energization control, the valve body including a first valve body that is displaced according to an energization or non-energization of the electromagnetic section and a second valve body that is located coaxially with the first valve body and is displaced in respond to a movement of the first valve body, the first valve body that is displaced toward the second valve body by a biasing force of a first biasing portion and abuts against the second valve body, in the non-energization of the electromagnetic section, the first valve body that is displaced by cancelling the biasing force of the first biasing portion and abuts against a first movement limiting member that limits the movement of the first valve body, in the energization of the electromagnetic section, the second valve body that is removed from a valve seat by cancelling a biasing force of a second biasing portion and is displaced to a position to abut against a second movement limiting member that limits a movement of the second valve body, when the second valve body is pressed in the axial direction by the first valve body that is displaced toward the second valve body by the biasing force of the first biasing portion, the second valve body that is seated on the valve seat by being separated by the biasing force of the second biasing portion from the position where the second valve body abuts against the second movement limiting member, when the first valve body is displaced toward the first movement limiting member, the control device for the high-pressure pump comprising:

a movement detection section detecting movement of the valve body during a downstroke of the plunger with respect to a drive command of the valve opening of the control valve, based on a change in the voltage across the electromagnetic section, in a period subsequent to the following sequence in order:

the electromagnetic section is energized according to a drive command of the valve closing of the control valve, the energization of the electromagnetic section is stopped according to the drive command of the valve opening of the control valve, and the voltage across the electromagnetic section is converged to and stabilizes at zero; wherein the movement detection section detects the movement of the valve body during the downstroke of the plunger prior to any additional drive command of the valve closing of the control valve.

2. The control device for the high-pressure pump according to claim 1, wherein in the period, the movement detection section determines that the valve body shows a normal movement when a bending point in response to the change in the voltage across the electromagnetic section is detected, and the movement detection section determines that the valve body does not show the normal movement when the bending point is not detected.

3. The control device for the high-pressure pump according to claim 1, further comprising:

a changing section configured to reverse the direction of the voltage across the electromagnetic section by a flyback right after switching to the drive command of the valve opening of the control valve, wherein the movement detection section detects the movement of the valve body in a period subsequent to the following sequence in order:

the changing section switches to the drive command of the valve opening of the control valve, the changing section changes the voltage in the reverse direction by the flyback, and the voltage across the electromagnetic section is converged to zero.

4. The control device for the high-pressure pump according to claim 1, further comprising:

an actuation determination section making an actuation determination of the high-pressure pump based on a detection result of the movement detection section.

5. The control device for the high-pressure pump according to claim 1, further comprising:

an abnormality diagnosis section diagnosing abnormality of the high-pressure pump based on a detection result of the movement detection section.

* * * * *